US006828274B2

(12) United States Patent
Onishi et al.

(10) Patent No.: US 6,828,274 B2
(45) Date of Patent: Dec. 7, 2004

(54) FLUORESCENT LATENT IMAGE TRANSFER FILM, FLUORESCENT LATENT IMAGE TRANSFER METHOD USING THE SAME, AND SECURITY PATTERN FORMED MATTER

(75) Inventors: Jiro Onishi, Tokyo-to (JP); Katsuyuki Oshima, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 133 days.

(21) Appl. No.: 10/047,838

(22) Filed: Jan. 14, 2002

(65) Prior Publication Data

US 2002/0150701 A1 Oct. 17, 2002

Related U.S. Application Data

(62) Division of application No. 09/373,442, filed on Aug. 12, 1999, now Pat. No. 6,368,684.

(30) Foreign Application Priority Data

Aug. 28, 1998 (JP) ..... P10-259456
Sep. 30, 1998 (JP) ..... P10-293077

(51) Int. Cl.[7] ..... B41M 5/00; B41M 5/038; B41M 5/35

(52) U.S. Cl. ..... 503/227; 156/235; 428/32.76; 428/32.77; 428/32.79; 428/690

(58) Field of Search ..... 428/32.76, 32.77, 428/32.79, 690; 503/227; 156/235; 8/471

(56) References Cited

U.S. PATENT DOCUMENTS 6,001,771 A * 12/1999 Nakano et al. ..... 503/227

* cited by examiner

*Primary Examiner*—Bruce H. Hess
(74) *Attorney, Agent, or Firm*—Ladas & Parry

(57) ABSTRACT

An object is to provide a fluorescent latent image transfer film which makes it possible to form a fluorescent latent image excellent in transferability and gradiation-property; a fluorescent latent image transfer method using the same; and a security pattern formed matter. To attain the object, there are provided a fluorescent latent image transfer film wherein a fluorescent ink layer formed of a resin binder comprising a fluorescent agent represented by the following formula (1) is formed on one surface of a heat-resistant substrate film; and a fluorescent latent image transfer method comprising the steps of putting this fluorescent latent image transfer film onto a transfer receiving material; heating the resultant in any pattern from the heat-resistant substrate film side of the fluorescent latent image transfer film by means of a heating element to transfer the fluorescent ink layer of the fluorescent latent image transfer film, correspondingly to the pattern of the heating element, onto the transfer receiving material, thereby forming a fluorescent latent image composed of the fluorescent agent on the transfer receiving material.

(1)

wherein R1 is $-(CH{=}CH)_n-$ or (n is a positive integer), and R2 and R3 each represents H or an alkyl group.

5 Claims, 17 Drawing Sheets

FLUORESCENT LATENT IMAGE TRANSFER FILM, FLUORESCENT LATENT IMAGE TRANSFER METHOD USING THE SAME, AND SECURITY PATTERN FORMED MATTER

This application is a division of U.S. Ser. No. 09/373,442 filed Aug. 12, 1999, now U.S. Pat. No. 6,368,684 which U.S. application is hereby incorporated herein by reference.

BACKGROUND OF THE INVENTION

The present invention relates to a fluorescent latent image transfer film, and a method for forming an fluorescent latent image by using this film, and more specifically to a fluorescent latent image transfer film making it possible to form any fluorescent latent image of any photograph, any pattern, any character or the like onto a transfer receiving material so as to form an image excellent in design and capability of preventing falsification; a method for transferring such a fluorescent latent image; and a security pattern formed matter having a fluorescent latent image.

In order to prevent forgery or falsification of a printed matter such as a document, a note or a card, there have hitherto been known means for forming a fluorescent latent image, which cannot be recognized through usual visible rays but emit fluorescence at the time of receiving ultraviolet rays so as to be recognized, into any pattern. In order to form this fluorescent latent image, there is usually used a method of printing the fluorescent latent image with a fluorescence developing ink.

Hitherto, as a simple printing method, a thermal transfer method has widely been used. This method makes it possible to form various images simply, so as to be used for the preparation of printed matters the print-number of which is a few, for example, cards such as an ID card.

A fluorescent latent image can be recorded onto a transfer receiving material, such as a card, by heating a thermal transfer film having a thermal transfer layer containing a fluorescent agent with a heating means such as a thermal head or a laser. The thermal transfer method includes sublimation type thermal transfer recording method and heat fusible type thermal recording method. In the sublimation type thermal transfer recording method, a sublimation dye is used and the dye is sublimated and transferred with the above-mentioned heating means. In the heat fusible thermal recording, there is used a heat fusible ink containing a colorant such as a pigment in a vehicle such as a wax, and ink in a heat fusible ink layer is softened with the heating means and the softened ink is transferred for recording.

In the heat fusible thermal recording, it is possible to form an image of a character, a number or the like easily and vividly. In the sublimation thermal transfer recording, gradiation-property is excellent, so that an image such as a facial photograph can be precisely and beautifully formed. The respective recording manners have such features.

Japanese Patent Application Laid-Open Nos. 2-106359, 6-316167, 7-223376, 7-117366 and the like disclose a sublimation thermal transfer film making it possible to record and form a fluorescent latent image having continuous gradation. These publications also describe various kinds of fluorescent compounds for forming a fluorescent latent image.

However, in the transfer film using the fluorescent compound described in the above-mentioned publications, and a method of using this transfer film to form a fluorescent latent image, there remains a problem that transferability of the fluorescent latent image and gradiation-property are not sufficient.

In the case that fluorescent ink is used to make a given pattern of the fluorescent ink by printing, the following problems arise.

(1) Since the fluorescent ink pattern is made by printing, a sufficient amount of the applied ink cannot be ensured. Thus, the degree of fluorescence color development is insufficient.

(2) If the amount of the applied ink is increased at the time of printing to obtain sufficient color development brightness, print reproduction of a minute pattern deteriorates. If the layer of the ink becomes thick, unevenness is generated in the raw matters subjected to printing-process. As a result, if the matters are long sheets, they may be subjected to blocking.

(3) In the case that the amount of a fluorescent pigment component is increased in a fluorescent pigment ink to raise the ratio of the fluorescent pigment to a binder resin which is a vehicle (abbreviated to the ratio of P/V hereinafter) and raise the luminescence intensity of a fluorescent latent image, accordingly, the print layer made of the ink whitens because of high concentration of the fluorescent pigment. Unfavorably, therefore, a portion where an image is printed with the fluorescent ink is easily recognized with eyes.

Japanese Patent application No. 4-319918 (Japanese Patent Application Laid-Open No. 6-166264) describes a method of using an ink containing an ultraviolet ray absorber to perform printing and forming on a sheet having a fluorescent latent image, thereby obtaining a fluorescent latent image having a specified pattern.

In this method, however, it is necessary to cause a support medium (a medium to be recorded) having a recording layer to contain a fluorescent material beforehand. For the formation of the pattern used the ultraviolet ray absorber, it is essential to use the special medium to be recorded which contains the fluorescent material. Thus, it is impossible to use plain paper to which such a processing is not applied. Therefore, the medium to be recorded is restrictive. This method cannot widely be used.

SUMMARY OF THE INVENTION

In the light of the above-mentioned problems in the prior art, an object of the present invention is to provide a fluorescent latent image transfer film making it possible to form a fluorescent latent image excellent in transferability and gradiation-property; a fluorescent latent image transfer method using the same; and a printed matter on which a fluorescent latent image is formed.

Another object of the present invention is to provide a security pattern formed matter making it possible to obtain sufficient brightness of a fluorescent latent image pattern, and recognize the fluorescent image easily without having a bad influence on the raw material of during printing-process.

In order to attain the above-mentioned objects, in the present invention there is provided a fluorescent latent image transfer film wherein a fluorescent ink layer formed of a resin binder comprising a fluorescent agent represented by the following formula (1) is formed on/above a heat-resistant substrate film.

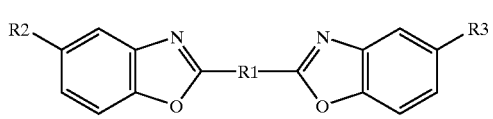

(1)

wherein R1 is $-(CH{=}CH)_n-$ or

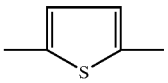

(n is a positive integer), and R2 and R3 each represents H or an alkyl group.

In the above described fluorescent latent image transfer film, the resin binder is composed mainly of a polyvinyl acetal resin, a polyvinyl butyral resin, or a mixture thereof.

In the fluorescent latent image transfer film, one or more layers selected from at least one of yellow, magenta, cyan and black thermal sublimation dye layers, and a heat fusible black ink layer are formed on and successively along a transfer face on which the fluorescent ink layer is formed.

In the fluorescent latent image transfer film, a protective layer is formed on and successively along the transfer face on which the fluorescent ink layer is formed.

In the fluorescent latent image transfer film, a thermal transfer intermediate adhesive layer is formed on and successively along the transfer face on which the fluorescent ink layer is formed.

In the fluorescent latent image transfer film, the total area of the formed yellow, magenta, cyan thermal sublimation dye layers, which is formed successively along the transfer face, is smaller than the total area, on/above the same substrate film, of layers selected from at least one of the thermal sublimation black layer, the heat-meting black ink layer, the fluorescent ink layer, the protective layer, and the thermal transfer intermediate adhesive layer.

In order to attain the above-mentioned objects, in the present invention there is provided a fluorescent latent image transfer method comprising the steps of putting, onto a transfer receiving material, a fluorescent latent image transfer film wherein a fluorescent ink layer formed of a resin binder comprising a fluorescent agent represented by the following formula (1) is deposited on/above a heat-resistant substrate film; heating the resultant in any pattern from the heat-resistant substrate film side of the fluorescent latent image transfer film by means of a heating element to transfer the fluorescent ink layer of the fluorescent latent image transfer film, correspondingly to the pattern of the heating element, onto the transfer receiving material, thereby forming a fluorescent latent image composed of the fluorescent agent on the transfer receiving material.

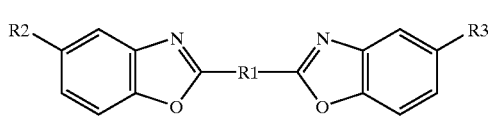

(1)

wherein R1 is $-(CH{=}CH)_n-$ or

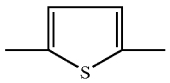

(n is a positive integer), and R2 and R3 each represents H or an alkyl group.

In the fluorescent latent image transfer method, the fluorescent latent image is formed after an image composed of a visible ink is formed on the surface of the transfer receiving material.

In the fluorescent latent image transfer, an image composed of a visible ink is formed after the fluorescent latent image is formed on the surface of the transfer receiving material.

In the fluorescent latent image transfer method, preferably, the fluorescent latent image is formed in the middle of forming an image composed of a visible ink on the surface of the transfer receiving material.

In the fluorescent latent image transfer method, preferably, a protective layer is formed on the topmost surface of the transfer receiving material.

In the fluorescent latent image transfer method, in which the fluorescent latent image is formed after an image composed of a visible ink is formed on the surface of the transfer receiving material, preferably, a protective layer is formed after the visible image composed of the visible ink is formed, and the fluorescent latent image is formed on the surface of the protective layer.

In the fluorescent latent image transfer method, preferably, there is used a fluorescent ink layer integrated film wherein one or more layers selected from at least one of yellow, magenta, cyan and black thermal sublimation dye layers, a heat fusible black ink layer and the protective layer are formed on and successively along a transfer face on which the fluorescent ink layer is formed, so as to form the fluorescent latent image, the image composed of the visible ink, the protective layer and the like successively.

In the fluorescent latent image transfer method, preferably, a hologram pattern is formed in the protective layer, and the transfer receiving material is a card, a passport, or a license.

In the present invention, there is also provided a printed matter having a fluorescent latent image formed by the above-mentioned fluorescent latent image transfer method.

In order to attain the above-mentioned objects, in the present invention, there is provided a security pattern formed matter, which is a printed matter wherein a receptor layer on which information is recorded and a security pattern formed of a fluorescent latent image are at least formed on a surface of a transfer receiving material, the security pattern being composed of a fluorescent material layer and an ultraviolet ray absorption pattern deposited into a pattern form on/above the fluorescent material layer, and an intermediate transfer medium wherein the receptor layer, the ultraviolet ray absorption pattern, and the fluorescent material layer are formed as a transfer layer being used so that the transfer layer of the intermediate transfer medium is transferred onto the surface of the transfer receiving material.

In the security pattern formed matter, preferably, the ultraviolet ray absorption pattern is formed by using an ultraviolet ray absorber transfer film having an ultraviolet ray absorber layer, and heating the transfer film in any pattern by means of a heating element to transfer the ultraviolet ray absorber layer correspondingly to the pattern of the heating means.

In the security pattern formed matter, preferably, the fluorescent material layer is a layer formed by using a fluorescent latent image transfer film having a fluorescent ink layer composed of a resin binder comprising a fluorescent agent.

In order to attain the above-mentioned objects, in the present invention there is provided a method for forming a security pattern formed matter, comprising the steps of using an intermediate transfer medium wherein a transfer layer comprising a fluorescent latent image composed of an ultraviolet ray absorption pattern and a fluorescent material layer, and a receptor layer on which information is recorded is formed on a substrate film, so as to transfer the transfer layer of the intermediate transfer medium on a transfer receiving medium, thereby forming a security pattern, the intermediate transfer medium being a medium wherein the fluorescent latent image is formed in the manner that the ultraviolet ray pattern in the transfer layer after the transfer is positioned on/above the fluorescent ink layer.

In the present invention, there is also provided a dye transfer film, which is a thermal transfer medium wherein a dye layer and an adhesive layer are formed on and successively along a surface of a substrate film, the adhesive layer comprising a fluorescent material.

The "image" referred to in the present invention means all of matters that can be recorded as information, for example, an image having continuous gradation, such as a photograph, and monochromic or full color printed characters having no gradiation, symbols, pattern or the like. The fluorescent latent image transferred from the fluorescent ink layer and formed is an image that cannot be seen through usual visible rays but can be seen by absorbing ultraviolet rays when the image is irradiated with the ultraviolet rays. In order to prevent printed matters from being forged or copied, a secret code or an image which can be used for identification may be used. Specific examples thereof include a printed photograph having gradation, and characters, illustrations and abstract patterns having no gradation. An image composed of a visible ink, which is different from the fluorescent latent image and may be referred to as a visible image, means an image which is formed by a common printing or transferring method and can be seen with eyes under usual conditions.

The fluorescent latent image transfer film according to the present invention has the fluorescent ink layer. Thus, if the fluorescent latent image transfer film is put on a transfer receiving material and then the fluorescent ink layer is heated with a head of a thermal printer or the like, only the fluorescent agent of the fluorescent ink layer is transferred to the surface of the transfer receiving material so that a fluorescent image having continues gradation can be formed. This fluorescent image cannot be seen through visible rays, but can be clearly recognized when being irradiated with ultraviolet rays. Therefore, by using this image, it can be judged whether or not the transfer receiving material is true. As a result, it is possible to prevent forgery or falsification, such as copy of the transfer receiving material, satisfactorily.

The fluorescent latent image transfer film of the present invention has the fluorescent agent comprising the resin binder containing the above-mentioned specific fluorescent compound. Therefore, the film is excellent in transferability and the gradiation-property of a fluorescent latent image.

The fluorescent latent image transfer method of the present invention is a method of using the fluorescent latent image transfer film having the fluorescent ink layer containing the specific fluorescent agent to perform transfer. Therefore, it is possible to form a fluorescent latent image having continues gradation satisfactory. This fluorescent image cannot be seen through visible rays, but can be clearly recognized when being irradiated with ultraviolet rays. According to the printed matter of the present invention, therefore, by using this fluorescent image, it can be judged whether or not the printed matter is true. As a result, it is possible to prevent forgery or falsification, such as copy of the printed matter, satisfactorily. The fluorescent ink comprising the resin binder containing the above-mentioned specific fluorescent agent is excellent in transferability and the gradiation-property of a fluorescent latent image.

According to the security pattern formed matter of the present invention, it is possible to obtain sufficient brightness of a fluorescent latent image pattern, and recognize easily the fluorescent image without having a bad influence on the raw material during printing process.

DESCRIPTION OF THE PREFERRED EMBODIMENTS

Figure 1:
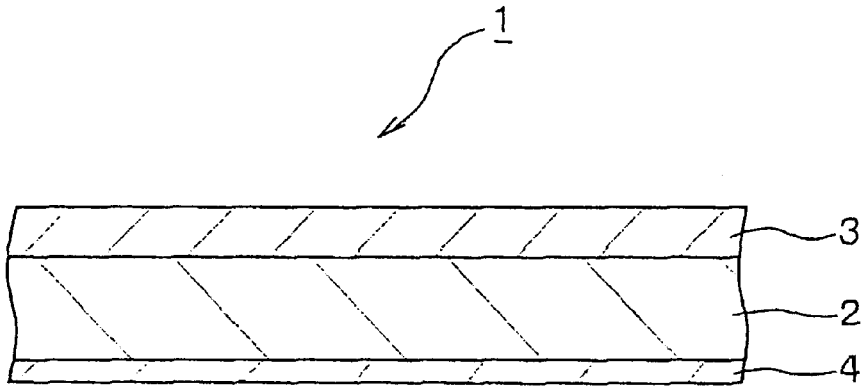
FIG. 1 is a vertical sectional view of a main portion of an example of the fluorescent latent image transfer film of the present invention.

Referring to the attached drawings, the present invention will be specifically described hereinafter. A fluorescent latent image transfer film 1 of the present invention comprises a fluorescent ink layer 3 formed of a resin binder containing a fluorescent agent on one face of a heat-resistant substrate film 2. The fluorescent latent image transfer method of the present invention comprises the steps of putting this fluorescent latent image transfer film 1 on a transfer receiving material in such a manner that the fluorescent ink layer 3 and a surface to be subjected to the transfer contact each other; and heating the resultant in any pattern form, from the side of the heat-resistant substrate film 2 of the fluorescent latent image transfer film 1, with a heating element, so as to transfer the fluorescent ink layer 3 of the fluorescent latent image transfer film 1, correspondingly to the pattern of the heating element, to the transfer receiving material. In this way, any fluorescent latent image formed of the fluorescent agent is formed on the transfer receiving material.

The following will describe the fluorescent latent image transfer film of the present invention.

The heat-resistant substrate film 2 of the fluorescent latent image transfer film 1 may be any one if it has heat-resistance against heat generated at the time of transfer, some degree of strength and good dimensional stability. For example, there are used a paper, various kinds of processed papers, plastic films and the like. Examples of raw materials of the plastic films include polyesters such as polyethylene terephthalate; polystyrene; polypropylene; polysulfone; polyphenylene sulfide; polyethylene naphthalate; 1,4-polycyclohexylene dimethylterephthalate; aramide; polycarbonate; polyvinyl alcohol; and cellophane. The thickness of the heat-resistant substrate film 2 is preferably 0.5–50 $\mu$m, and more preferably 3–10 $\mu$m. A preferred material of the film 2 is a polyethylene terephthalate film.

The heat-resistant substrate film 2 may be in a leaf form or a continuous film form. The surface thereof may be subjected to primer treatment or the like, in order to raise the adhesive property of the film 2 to the fluorescent ink layer or other layers deposited on the film 2. The fluorescent latent image transfer film 1 has a back layer 4 at the side opposite to itself.

As the fluorescent agent used in the fluorescent ink layer 3, compounds represented by the formula (1) may be used. Specific examples of the compounds include compounds shown in Table 1. Among these compounds, compounds wherein R1 is thiophen, and R2 and R3 are t-butyl groups are especially preferred since they make it possible to form a fluorescent latent image excellent in transferability and gradiation-property.

TABLE 1

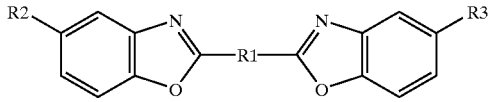

| Fluorescent compound No. | R1 | R2 | R3 |
|---|---|---|---|
| 1 | —CH=CH— | H | H |
| 2 | —(CH=CH)$_2$— | H | H |
| 3 | —(CH=CH)$_3$— | H | H |
| 4 | —(CH=CH)$_3$— | Methyl | Methyl |
| 5 | —(CH=CH)$_3$— | t-Butyl | t-Butyl |
| 6 | 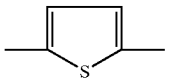 | H | H |
| 7 | 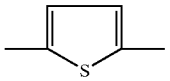 | Methyl | Methyl |
| 8 | 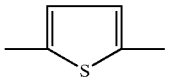 | t-Butyl | t-Butyl |

Examples of the binder resins used in the fluorescent ink layer 3 include cellulose resins such as ethylcellulose, ethylhydroxycellulose, hydroxypropylcellulose, methylcellulose and cellulose acetate; vinyl resins such as polyvinyl alcohol, polyvinyl acetate, polyvinyl butyral, polyvinyl acetal and polyvinyl pyrrolidone; acrylic resins such as poly (meth) acrylate and poly (meth) acrylamide; polyurethane resins; polyamide resins; polyester resins; and mixtures thereof. As the binder resin, polyvinyl butyral and polyvinyl acetal are preferred since they have good transferability of the fluorescent agent, and good preservation-stability when they are made up to the transfer film. The thickness of the fluorescent ink layer 3 is preferably set up in the manner that the amount of the layer 3 is 0.1–5.0 g/m$^2$.

The fluorescent ink layer 3 may be made by applying an ink containing the fluorescent agent, the binder resin, and other additives in a known coating manner such as gravure coating.

The back layer 4 is formed to prevent the present film from being melted and sticking to a heating element such as a thermal head, or to improve the efficiency that the present film is fed. The back layer 4 makes it possible to prevent the back surface of the present transfer film from sticking to the topmost surface layer such as the fluorescent ink layer when the transfer film is wound into a roll form or stacked into a sheet form. It is preferred that the back layer 4 has heat-resistance sliding ability and releasing ability. Examples of raw materials of the back layer include raw materials having releasing ability, such as hardening silicone oil, hardening silicone wax, silicone resin, fluorine resin and acrylic resin. The thickness of the back layer 4 usually ranges from 0.1 to 3.0 $\mu$m.

The fluorescent latent image transfer film may be made up into any form, such as a sheet, continuous roll or ribbon. In the fluorescent latent image transfer film shown in FIG. 1, the fluorescent ink layer 3 is printed and formed on the whole surface of the transfer layer. In the fluorescent latent image transfer film of the present invention, however, areas such as a thermal sublimation dye layer 5 and a heat fusible ink layer 6, in addition to the fluorescent ink layer 3, may be formed on the substrate film 2 and successively along the feeding direction of the film sheet. Areas of a protective layer 7 may be formed. The following will describe such other embodiments of the present invention.

Figure 2:
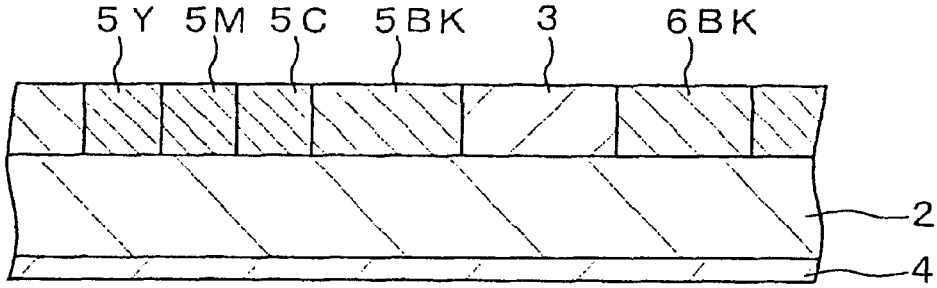
FIG. 2 is a vertical sectional view of a main portion of another example of the fluorescent latent image transfer film of the present invention.

In a fluorescent latent image transfer film 1 shown in FIG. 2, respective areas of thermal sublimation dye layers 5, such as a yellow dye layer 5Y, a magenta dye layer 5M, a cyan dye layer 5C and a black dye layer 5BK, a fluorescent ink layer 3 and a heat fusible ink layer 6B in black may be formed on and successively along a single transfer face of a heat-resistant substrate film 2, on which the fluorescent ink layer 3 is formed. Areas having this constituent unit are repeatedly formed along the feeding direction of the film 1. A back layer 4 is formed on the other surface of the heat-resistant substrate film 2. In this embodiment, it is sufficient that at least one of the yellow dye layer 5Y, the magenta dye layer 5M, the cyan dye layer 5C and the black dye layer 5BK, and the heat fusible ink layer 6 in black (heat fusible black ink layer 6BK) is formed, as transfer layer(s) besides the fluorescent ink layer 3, on the same transfer face that has the fluorescent ink layer 3.

Figure 3:
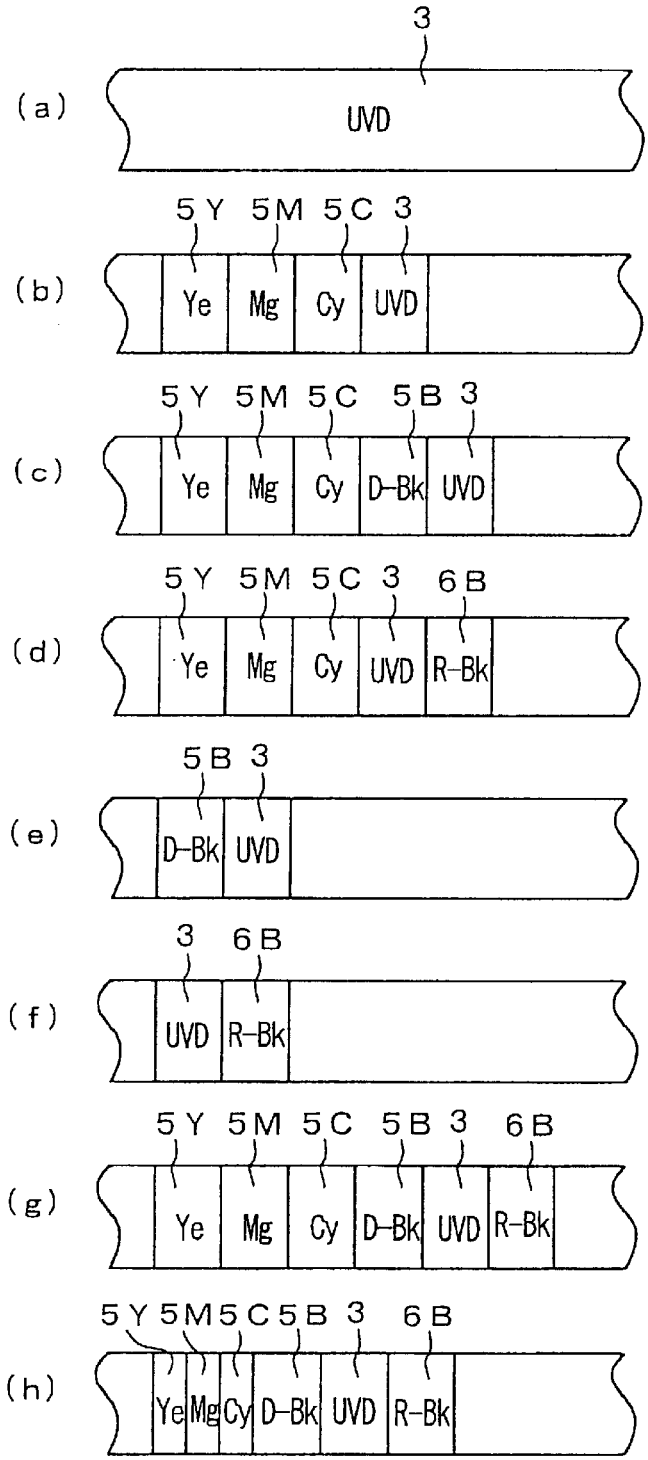
FIGS. 3(*a*)–(*h*) are plane views of embodiments of the fluorescent latent image transfer film of the present invention.

FIGS. 3(*a*)–3(*h*) are plane views illustrating embodiments of the fluorescent latent image transfer film according to the present invention wherein thermal sublimation dye layers 5 and a heat fusible ink layer 6 are arranged as layers besides a fluorescent ink layer 3. As illustrated in these figures, areas of the fluorescent ink layer 3, the thermal sublimation dye layers 5 (5Y, 5M, 5C and 5BK), the heat fusible ink layers 6 and the like may be formed in an arbitrary order. (The areas may be referred to as panels.) The length of the respective areas is not limited and may be arbitrary. In the embodiments shown in FIGS. 3(*a*)–3(*h*), the arrangement orders of the respective areas in a direction along the transfer face are set up as follows. Areas having this basic constituent unit are repeatedly formed along the feeding direction of the transfer film.

(a) A film composed of only the fluorescent ink layer 3.
(b) The yellow dye layer 5Y, the magenta dye layer 5M, the cyan dye layer 5C and the fluorescent ink layer 3.
(c) The yellow dye layer 5Y, the magenta dye layer 5M, the cyan dye layer 5C, the black dye layer 5BK and the fluorescent ink layer 3.
(d) The yellow dye layer 5Y, the magenta dye layer 5M, the cyan dye layer 5C, the fluorescent ink layer 3 and the heat fusible black ink layer 6BK.
(e) The back dye layer 5BK and the fluorescent ink layer 3.
(f) The fluorescent ink layer 3 and the heat fusible black ink layer 6BK.
(g) The yellow dye layer 5Y, the magenta dye layer 5M, the cyan dye layer 5C, the black dye layer 5 BK, the fluorescent ink layer 3 and the heat fusible black ink layer 6BK.
(h) The areas having the same order as the (g). However, the total areas of the yellow dye layer 5Y, the magenta dye layer 5M and the cyan dye layer 5C is smaller than the total area of the black dye layer 5BK, the fluorescent ink layer 3 and the heat fusible black ink layer 6B.

The thermal sublimation dye layer 5 may be formed by dissolving any one of yellow, magnet, cyan and black sublimation dyes, a binder resin, a releasing agent, other additives into a solvent to prepare a coating solution for the dye layer; applying the prepared each color coating solution onto given areas in the heat-resistant substrate film in various kinds of coating manners such as a gravure coating manner; and drying the resultant.

Examples of the yellow sublimation dye include Forron Brilliant Yellow-S-6GL (trade name of Disperses Yellow 231 made by Sand AG) and Macrolex Yellow 6G (trade name of Disperses Yellow 201 made by Bayer AG). Examples of the magenta sublimation dye include MS-REDG (trade name of Disperses Violet 26 made by Bayer AG). Examples of the cyan sublimation dye include Cayaset Blue 714 (trade name of Solvent Blue 63 made by Nippon Kayaku Co., Ltd.), Forron Brilliant Blue-S-R (trade name of Disperses Blue 354 made by Sand AG) and Waksolin AP-FW (trade name of Solvent Blue 36 made by ICI). Examples of the black sublimation dye include a mixture of the above-mentioned yellow, magenta and cyan dyes.

Examples of the binder resin of the thermal sublimation dye layer 5 include cellulose resins such as ethylcellulose, ethylhydroxycellulose, hydroxypropylcellulose, methylcellulose, cellulose acetate; vinyl resins such as polyvinyl alcohol, polyvinyl acetate, polyvinyl butyral, polyvinyl acetal and polyvinyl pyrrolidone; acrylic resins such as poly (meth) acrylate and poly (meth) acrylamide ((meth) means methacryl); polyurethane reins; polyamide resins; polyester resins; and mixture thereof. As the binder resin, polyvinyl butyral and polyvinyl acetal are preferred since they have good transferability of the dye, and good preservation-stability when they are made up to the transfer film.

The heat fusible ink layer 6 can be formed by applying a heat fusible ink containing a colorant, a vehicle and other additives in a known coating manner such as a hot-melt coating, hot-lacquer coating, gravure coating, gravure reverse coating, or roll coating manner. The thickness of the heat fusible ink layer 6 usually ranges from 0.2 to 10 $\mu$m. As the colorant of the heat fusible ink layer 6, it is preferred to use a black colorant optimal for recording high-density and vivid characters and symbols.

Examples of the vehicle of the heat fusible ink layer 6 include wax, and mixtures of wax and dry oil, resin, mineral oil, cellulose, derivatives of rubber, and the like. Examples of the wax include microcrystalline wax, carnauba wax, paraffin wax, Fisher-Tropishe wax, low molecular weight polyethylene, Japan wax (haze wax), bees wax, spermaceti wax, insect wax, wool wax, shelac wax, candelilla wax, petrolatum, partially-modified wax, esters of fatty acid, and amides of fatty acid.

Figure 4:
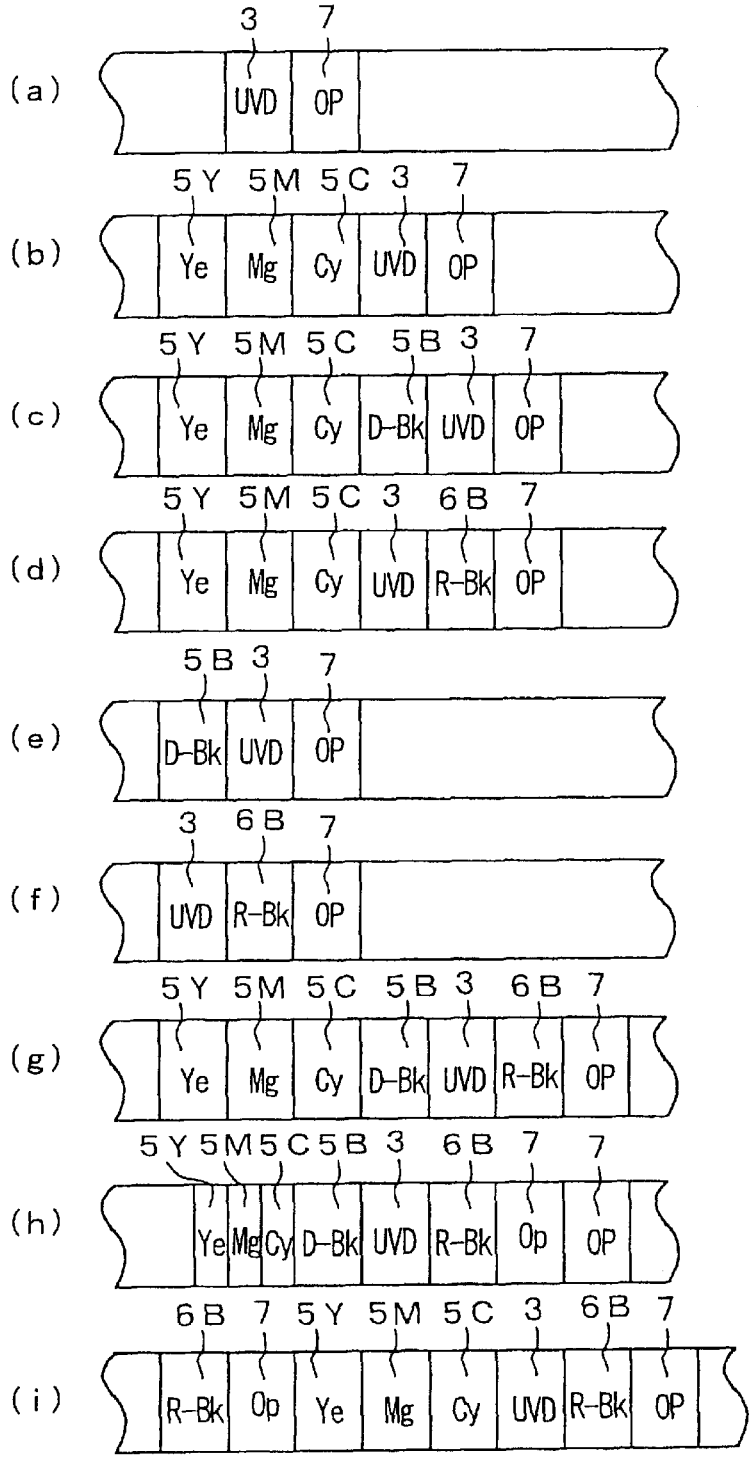
FIGS. 4(*a*)–(*i*) are plane views of embodiments of the fluorescent latent image transfer film of the present invention.

As illustrated in FIGS. 4(*a*)–4(*i*), in the fluorescent latent image transfer film of the present invention, a protective layer 7 may be formed, as a layer besides the fluorescent ink layer 3, on the same transfer face that has the fluorescent ink layer 3 and successively along the transfer face. Specifically, in the embodiments shown in FIGS. 4(*a*)–4(*i*), the arrangement orders of areas in a direction along the transfer face are set up as follows. Areas having this basic constituent unit are repeatedly formed along the feeding direction of the film.

(a) The fluorescent ink layer 3 and the protective layer 7.
(b) The yellow dye layer 5Y, the magenta dye layer 5M, the cyan dye layer 5C, the fluorescent ink layer 3 and the protective layer 7.
(c) The yellow dye layer 5Y, the magenta dye layer 5M, the cyan dye layer 5C, the black dye layer 5B, the fluorescent ink layer 3 and the protective layer 7.
(d) The yellow dye layer 5Y, the magenta dye layer 5M, the cyan dye layer 5C, the fluorescent ink layer 3, the heat fusible black ink layer 6BK and the protective layer 7.

(e) The back dye layer 5BK, the fluorescent ink layer 3 and the protective layer 7.

(f) The fluorescent ink layer 3, the heat fusible black ink layer 6BK and the protective layer 7.

(g) The yellow dye layer 5Y, the magenta dye layer 5M, the cyan dye layer 5C, the black dye layer 5 BK, the fluorescent ink layer 3, the heat fusible black ink layer 6BK and the protective layer 7.

(h) The areas having the same order as the (g). However, the total areas of the yellow dye layer 5Y, the magenta dye layer 5M and the cyan dye layer 5C is smaller than the total area of the black dye layer 5 BK, the fluorescent ink layer 3, the heat fusible black ink layer 6BK and the protective layer 7.

(i) The heat fusible black ink layer 6BK, the protective layer 7, the yellow dye layer 5Y, the magenta dye layer 5M, the cyan dye layer 5C, the fluorescent ink layer 3, the heat fusible black ink layer 6BK and the protective layer 7.

In FIG. 4, the position, i.e., the order of the panels except the protective layers is arbitrary. The position of the panels of the fluorescent ink layer 3 may be after the protective layer 7. In the case that images are directly transferred from the transfer film to a transfer receiving material, the following is preferred for positioning the protective layer 7 on the topmost surface of the transferred images so as to protect the images sufficiently. That is, it is generally preferred to arrange the protective layer 7 at the last position of the single constituent unit where areas are formed on and successively along the transfer face, as shown in FIGS. 4(*a*)–(*i*). The number of the protective layer 7 arranged on a single consitituent unit where areas are formed on and successively along the transfer face may be one or more, as shown in FIG. 4(*i*), wherein the protective layers 7 are arranged, for example, at two positions, i.e., after the heat fusible black ink layer 6BK and at the last position of the constituent unit.

The protective layer 7 can be formed by applying a coating composition containing a resin for forming the protective layer of such a kind of transfer film to the surface of the film substrate with a known coating means. The protective layer 7 is made up to a transparent layer making it possible to see images below the transparent layer after transfer, such as a colorless and transparent layer or a colored and transparent layer. Examples of the resin for forming the protective layer include polyester, polystyrene, acrylic, polyurethane, acrylic urethane resins; mixtures thereof; silicone-modified resins of these resins; mixtures of these modified resins; ionizing radiant ray hardening resins; and ultraviolet cutting-off resins. The thickness of the protective layer 7 usually ranges from 0.5 to 10 $\mu$m.

The protective layer containing the ionizing radiant ray hardening resin is especially excellent in plasticizer-resistance, and scratch-resistance. As the ionizing radiant ray hardening resin, known ones can be used. There may used, for example, a resin obtained by crosslinking or hardening a radical polymerizable polymer or oligomer by ionizing radiant rays, optionally adding a light polymerization initiator thereto, and applying electron rays or ultraviolet rays thereto for polymerization and crosslinking.

The protective layer containing the ultraviolet cutting-off resin has a main purpose of giving light-resistance to a printed matter. As the ultraviolet cutting-off resin, there may be used, for example, a resin obtained by reacting and bonding a reactive ultraviolet absorber with a thermoplastic resin or the above-mentioned ionizing radiant ray hardening resin. The reactive ultraviolet absorber is a substance obtained by introducing a reactive group such as an addition polymerizable double bond (e.g., a vinyl, acryloyl, or methacryloyl group), an alcoholic hydroxyl group, an amino group, a carboxyl group, an epoxy group, or an isocyanate group into a non-reactive, organic ultraviolet ray absorber such as salicylate, benzophenone, benzotriazole, substituted acrylonitryl, nickel-chelete, or hindered amine.

In the protective layer 7, a holographic pattern may be formed. Examples of the holographic pattern include an unevenness pattern based on relief holography or a diffraction grating.

Figure 5:
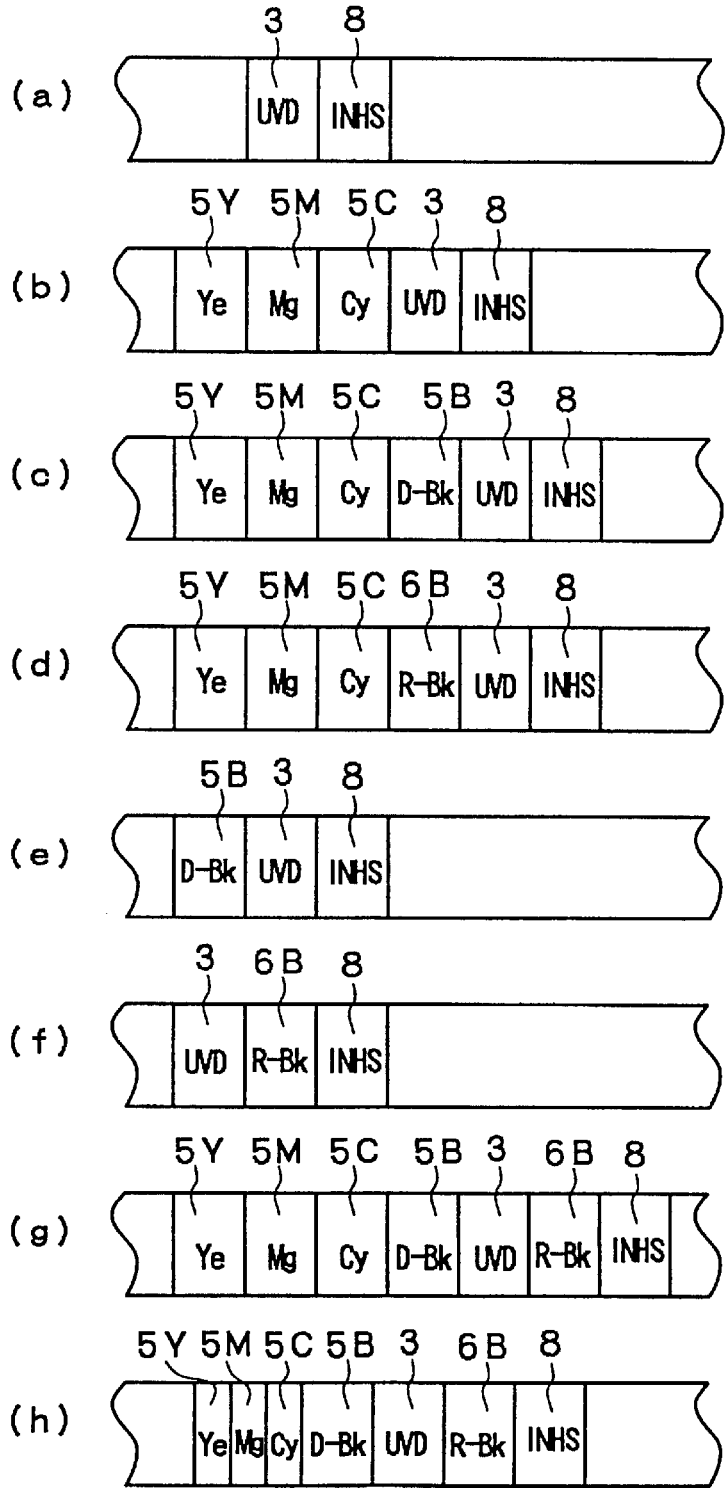
FIGS. 5(*a*)–(*h*) are plane views of embodiments of the fluorescent latent image transfer film of the present invention.

As illustrated in FIGS. 5(*a*)–5(*h*), in the fluorescent latent image transfer film according to the present invention, a thermal transfer intermediate adhesive layer 8 may be formed, as a layer besides a fluorescent ink layer 3, on and successively along the same transfer face that has the fluorescent ink layer 3. In the case that an image from transfer layers including the fluorescent ink layer 3 is transferred to the surface of an intermediate transfer medium and then this image is transferred to the surface of a transfer receiving material, the thermal transfer intermediate adhesive layer 8 is used to bond the image to the transfer receiving material. Therefore, the thermal transfer intermediate adhesive layer 8 is formed at the last area of the constituent unit so that the layer 8 is arranged on the topmost surface when the image is transferred to the surface of the intermediate transfer medium and formed. Specifically, in the embodiments shown in FIGS. 5(*a*)–5(*h*), the arrangement orders of areas in a direction along the transfer face are set up as follows. Areas having this basic constituent unit are repeatedly formed along the feeding direction of the film.

(a) The fluorescent ink layer 3 and the thermal transfer intermediate adhesive layer 8.

(b) The yellow dye layer 5Y, the magenta dye layer 5M, the cyan dye layer 5C, the fluorescent ink layer 3 and the thermal transfer intermediate adhesive layer 8.

(c) The yellow dye layer 5Y, the magenta dye layer 5M, the cyan dye layer 5C, the black dye 5B, the fluorescent ink layer 3 and the thermal transfer intermediate adhesive layer 8.

(d) The yellow dye layer 5Y, the magenta dye layer 5M, the cyan dye layer 5C, the heat fusible black ink 6B, the fluorescent ink layer 3, and the thermal transfer intermediate adhesive layer 8.

(e) The back dye 5B, the fluorescent ink layer 3 and the thermal transfer intermediate adhesive layer 8.

(f) The fluorescent ink layer 3, the heat fusible black ink layer 6B and the thermal transfer intermediate adhesive layer 8.

(g) The yellow dye layer 5Y, the magenta dye layer 5M, the cyan dye layer 5C, the black dye layer 5 B, the fluorescent ink layer 3, the heat fusible black ink 6B and the thermal transfer intermediate adhesive layer 8.

(h) The areas having the same order as the (g). However, the total areas of the yellow dye layer 5Y, the magenta dye layer 5M and the cyan dye layer 5C is smaller than the total area of the black dye layer 5BK, the fluorescent ink layer 3, the heat fusible black ink layer 6BK and the thermal transfer intermediate adhesive layer 8.

The thermal transfer intermediate adhesive layer 8 is made of a thermoplastic resin having good adhesion at the time of heating, such as acrylic, vinyl chloride, vinyl acetate, vinyl chloride/vinyl acetate copolymer, polyester, and polyamide resins. The thickness of the thermal transfer intermediate adhesive layer 8 usually ranges from 0.1 to 5 $\mu$m.

In the fluorescent latent image transfer film wherein plural areas of layers besides the fluorescent ink layer 3 are formed as transfer layers on and successively along the transfer face, the length (or the area) of the respective areas may be the same to form a transfer film where the respective areas have the same size. As in the embodiments shown in FIGS. 3(*h*), 4(*h*), and 5(*h*), however, the length of the yellow, magenta and cyan sublimation dye layers 5(5Y, 5M and 5C) may be made smaller so that the size, i.e., the area of the dye layers 5 is smaller than the area of the layers other than the dye layers 5 (i.e., the fluorescent ink layer 3, the thermal sublimation black dye layer 5B, the heat fusible black ink layer 6 and the protective layer 7, the thermal transfer intermediate adhesive layer 8, and the like).

A method of transferring and recording a fluorescent latent image image by using the fluorescent latent image transfer film 1 of the present invention comprises the steps of putting the fluorescent latent image transfer film on an image forming surface of a transfer receiving material, such as a card substrate, in such a manner that the image forming surface contacts the transfer face of the transfer film 1; and heating the resultant in a predetermined pattern form, from the back side of the transfer film 1, with a heating means such as a thermal head or a laser, so as to transfer a desired image to the surface of the transfer receiving material. In this way, a fluorescent latent image can be formed. In the case of using the fluorescent latent image transfer film having transfer layers besides the fluorescent ink layers 3, a printed image made of the sublimation dye layer, the protective layer, the adhesive layer and the like can be formed, as well as the fluorescent latent image.

Figure 6:
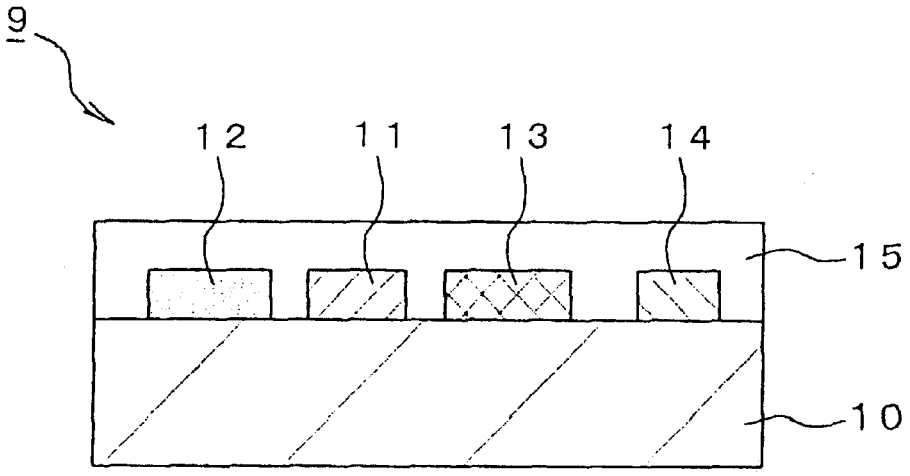
FIG. 6 is a schematic sectional view of an embodiment of the printed matter of the present invention.
Figure 7:
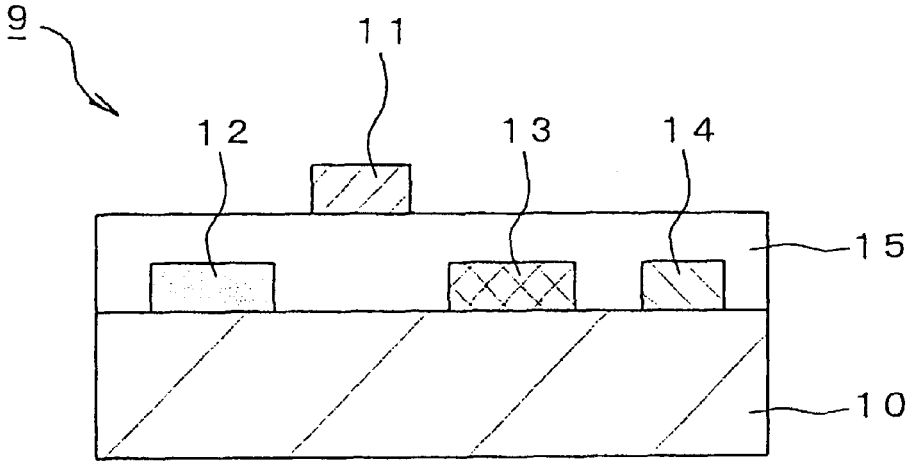
FIG. 7 is a schematic sectional view of another embodiment of the printed matter of the present invention.

FIGS. 6 and 7 are cross sections illustrating embodiments of printed matters formed by the method of the present invention for forming a fluorescent latent image transfer film. In a printed matter 9 illustrated in FIG. 5, a fluorescent latent image 11 and visible images such as a color transferred image 12 made of the sublimation dye, a monochromatic transferred image 13 made of the sublimation dye and a monochromatic transferred image 14 made of the heat fusible ink are formed on a surface of a transfer receiving material 10. Its surface is covered with a protective layer 15.

In a printed matter 9 illustrated in FIG. 7, visible images such as a color transferred image 12 made of the sublimation dye, a monochromatic transferred image 13 made of the sublimation dye and a monochromatic transferred image 14 made of the heat fusible ink are formed on a surface of a transfer receiving material 10. The whole of the surface of the images is covered with a protective layer 15. A fluorescent latent image 11 is formed on the surface of the protective layer 15.

The timing of forming the fluorescent latent image 11 in the present invention may be any one of timings (a) after forming a visible image, (b) before forming a visible image and (c) in the middle of forming a visible image. The position where the fluorescent latent image 11 is formed may be a position where the image 11 does not overlap a visible image, and a position where the image 11 overlaps a visible image, in the case of the above-mentioned (a). The position where the fluorescent latent image 11 is formed may be a position where the image 11 does not overlap a visible image, in the case of the above-mentioned (b).

In the case that the protective layer 15 is formed, the preservation of a visible image and fluorescent latent image 11 on a printed matter 9 is best when the protective layer 15 is formed as the topmost layer to cover the whole of the images, as shown in FIG. 6. Such an embodiment is best for cards and the like, for which endurance such as scratch-resistance is demanded. In the case that, as shown in FIG. 7, the fluorescent latent image 11 is formed on the surface of the protective layer 15, if the fluorescent latent image has a thickness similar to that of a fluorescent ink layer formed on the transfer film, fluorescent latent image 11 never hinders an underlying visible image from being seen. Thus, if the fluorescent latent image 11 is above the visible image, no problem arises. In this case, there is an advantage that the position where the fluorescent latent image 11 is formed is not restrictive. In this way, the forming position or order of the fluorescent latent image, the visible image and the protective layer of the printed matter can be appropriately selected in accordance with the use or the like of the printed matter.

The visible image and the protective layer can be formed by printing methods, coating methods, transfer methods using other transfer sheets, or the like. The present invention is however preferred for the following reason. That is, by using a transfer film where the above-mentioned sublimation dye layer, the heat fusible transfer layer, the protective layer, the fluorescent ink layer or the like are formed on and successively along its transfer face, an image made of the sublimation dye layer, the protective layer, and the like can be successively formed, as well as a fluorescent latent image.

The sublimation dye layer of such a fluorescent latent image transfer film is optimally used for forming an image having continues gradation, such as an image of a full color or monochrome photograph, but may be used for forming a full color or monochrome image having no gradation. The heat fusible black ink layer is optimally used for printing characters, symbols or the like which have no gradation.

As the transfer receiving material 10, which will make the printed matter 9, a thermal transfer image-receiving sheet is preferably used. The thermal transfer image-receiving sheet is a sheet wherein a receptor layer is formed on a surface of a substrate. Examples of the substrate include paper such as plain paper, synthetic paper and synthetic resin- or emulsion impregnated paper; and plastic sheets or films such a saturated polyester (e.g., polyethylene terephthalate), polyamide, polyethylene, polypropylene, polyacrylate, polycarbonate, polyurethane, polyvinyl chloride, polyvinyl acetate, polystyrene, cellulose resin, polysulfone, and polyimide. The substrate may be transparent or opaque. The substrate may have reflectiveness based on the addition of while pigment or the like thereto. The substrate may be made up into a card form.

The receptor layer of the thermal transfer image-receiving sheet is made of a resin which can be dyed with dye. Examples of this resin include saturated polyester, polyamide, polyacrylate, polycarbonate, polyurethane, polyvinyl acetal, polyvinyl chloride, vinyl chloride/vinyl acetate copolymer, polyvinyl acetate, polystyrene, styrene/acrylate copolymer, styrene/butadiene copolymer, vinyltoluene/acrylate copolymer, and cellulose resin. The resins may be used alone or in the form of a mixture of two or more kinds. Additives, such as a releasing agent for preventing the melting bond of the thermal transfer sheet and various colorants may be added to the receptor layer.

A releasing layer made of silicone oil, a fluorine compound, waxes may be formed at the back side of the thermal transfer image-receiving sheet (i.e., on the surface opposite to the receptor layer).

The thermal transfer image-receiving sheet may be made up into the form of having no printed images; a printed form; or a booklet or book form where images are beforehand printed.

A heating means such as a thermal head or a laser is used as a heating element used in transferring images of the fluorescent latent image transfer films, other sublimation dye transfer sheets or protective layer transfer sheets. The heating means is made so as to supply heat corresponding to image data to be transferred. As this heating means, commercially available one may be used.

The method for transferring a fluorescent latent image of the present invention can be optimally used to form cards, such as an identification card and a credit card; and warrants having a photograph and characters, such as a passport and a license.

The above-mentioned method for transferring a fluorescent latent image is a method of transferring a fluorescent ink layer, into a pattern, to a transfer receiving material (recorded medium) to form a fluorescent latent image. In the case that a binder capable of melting-transfer is used as the fluorescent ink layer in this method, both of the binder resin and the above-mentioned specified fluorescent agent are transferred to the transfer receiving material, so as to form a fluorescent latent image. In the case that a binder incapable of melting-transfer is used as the binder resin, only the fluorescent agent is transferred to the transfer receiving material to form a fluorescent latent image because the above-mentioned fluorescent agent of the fluorescent ink layer has sublimation ability.

The sublimation transfer is generally excellent in gradiation-property, but in this transfer the amount of the transferred dye or fluorescent agent is smaller and the density of formed images is lower than in melting transfer. Therefore, there is a disadvantage against obtaining vivid images. Thus, if gradiation-property is regarded as important, the sublimation transfer is selected among the above-mentioned transfer methods. In order to obtain sufficient brightness of a fluorescent latent image, there is used a method of transferring the fluorescent ink layer by the melting transfer method.

As described in the column of Background of the Invention in the specification, even if the melting transfer method is selected, an increase in the concentration of a fluorescent agent is restrictive in the method of transferring a fluorescent ink layer of a fluorescent latent image transfer film into a pattern form to a transfer receiving material to form a fluorescent latent image. In such a case, the following method for forming a fluorescent latent image can be used.

Figure 8:
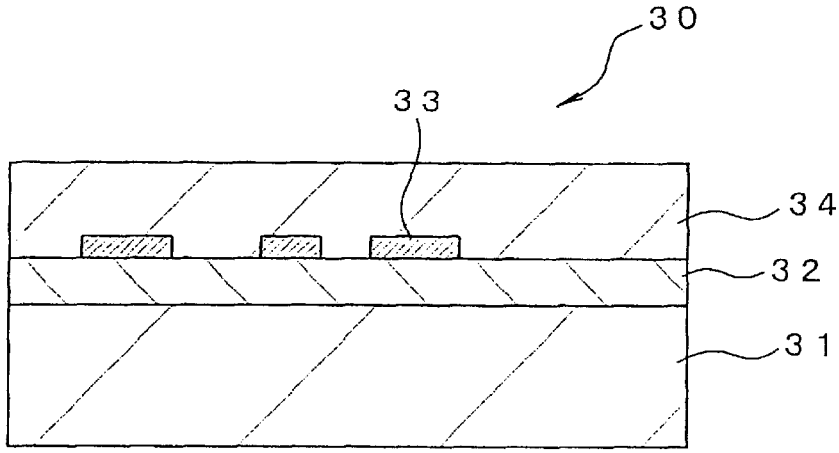
FIG. 8 is a schematic sectional view of an example of the intermediate transfer film used in the present invention.
Figure 12:
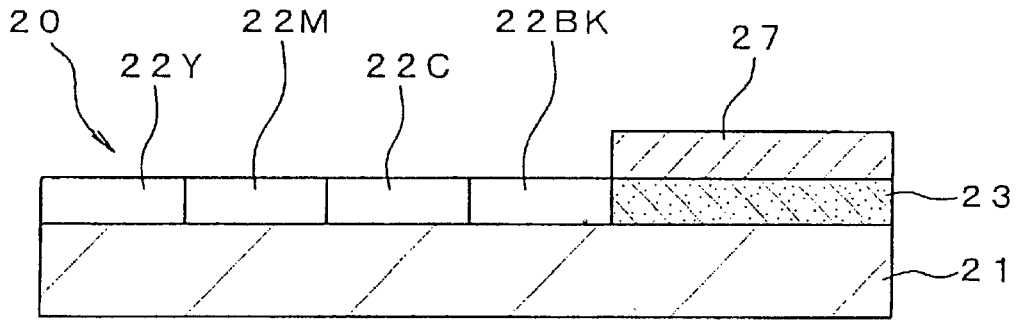
FIG. 12 is a schematic sectional view of an example of the dye transfer film used in the present invention.
Figure 15A:
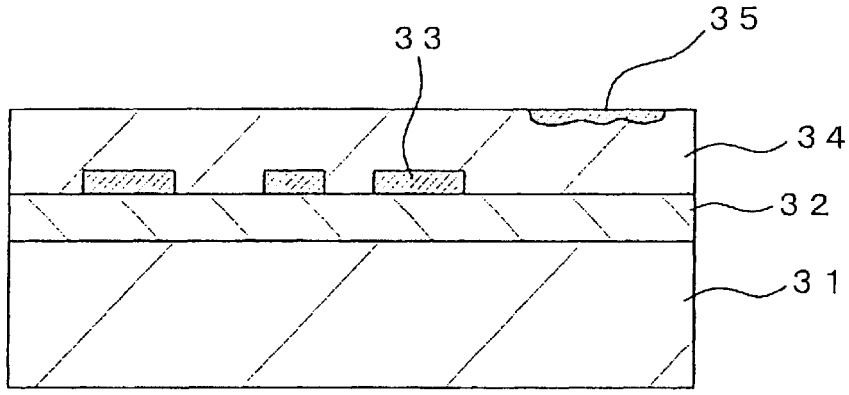
FIGS. 15(*a*)–(*c*) are schematic sectional views illustrating an example of the method for forming a security pattern formed matter of the present invention.
Figure 15B:
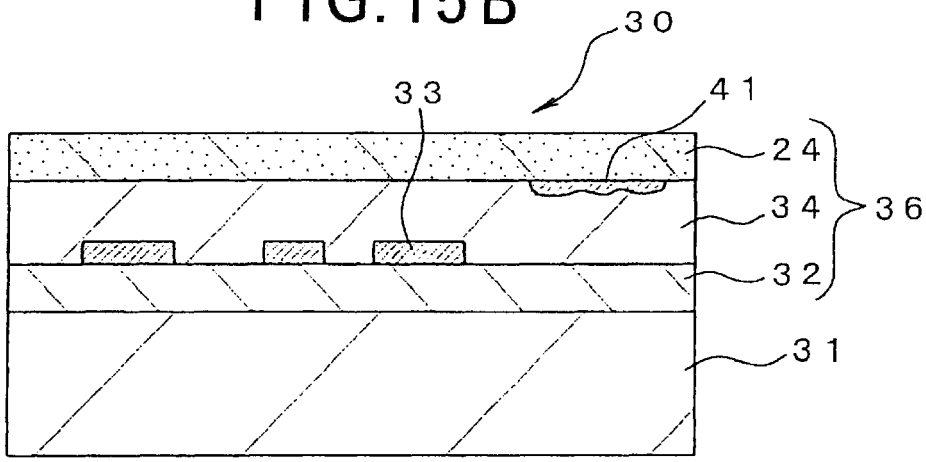
Figure 15C:
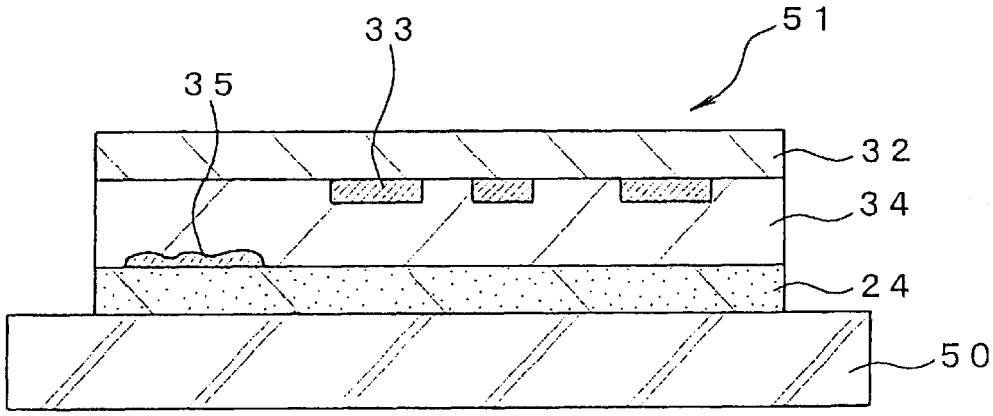
Figure 16A:
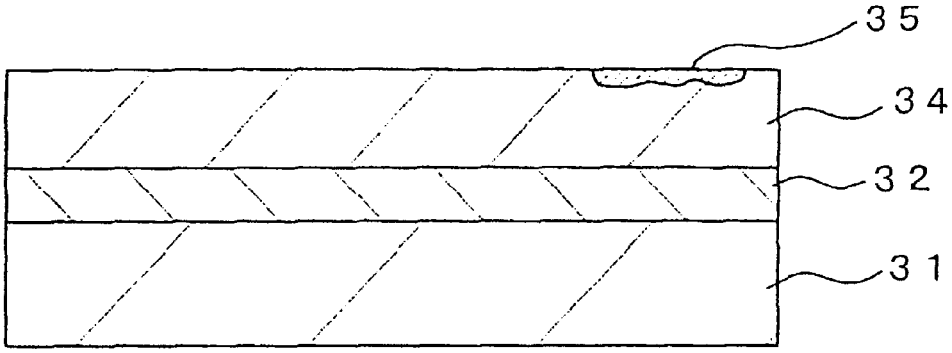
FIGS. 16(*a*)–(*d*) are schematic sectional views illustrating another example of the method for forming a security pattern formed matter of the present invention.
Figure 16B:
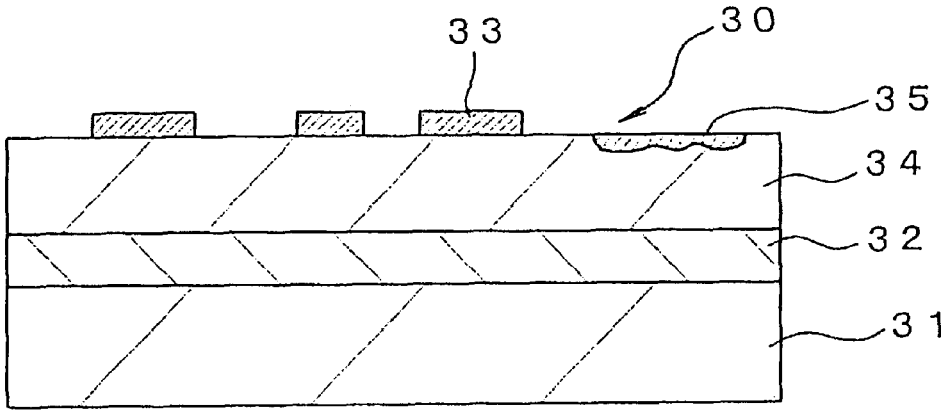
Figure 16C:
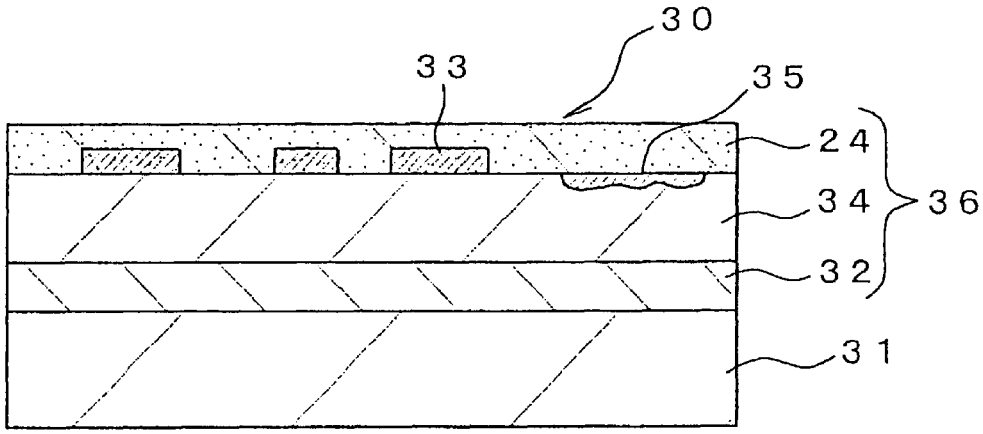
Figure 16D:
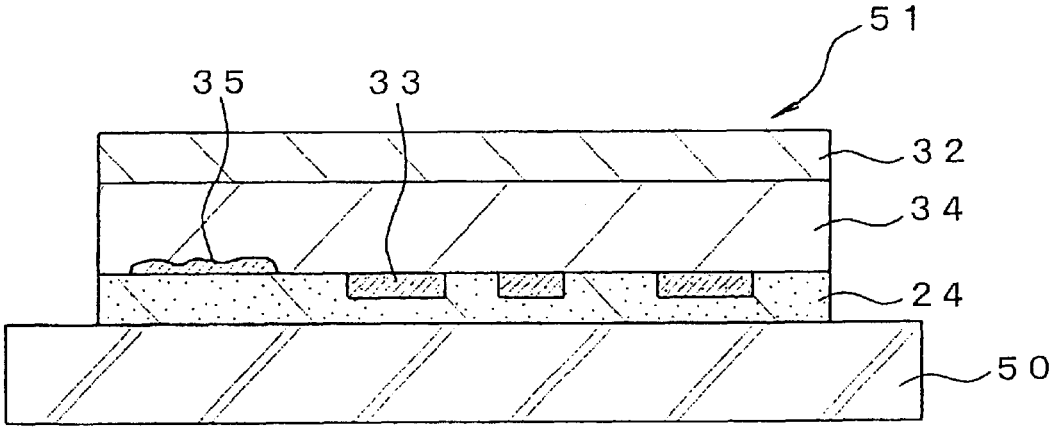
Figure 17A:
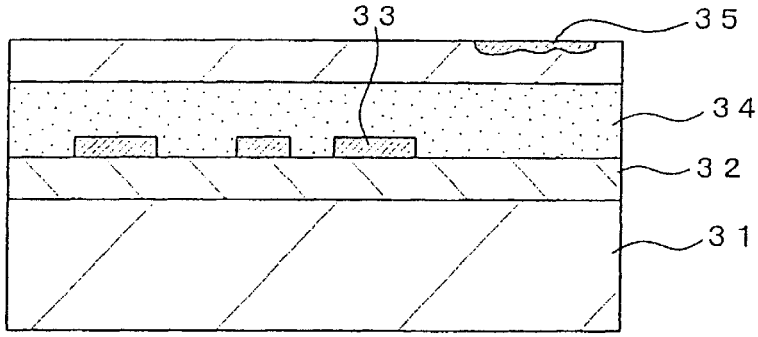
FIGS. 17(*a*)–(*c*) are schematic sectional views illustrating still another example of the method for forming a security pattern formed matter of the present invention.
Figure 17B:
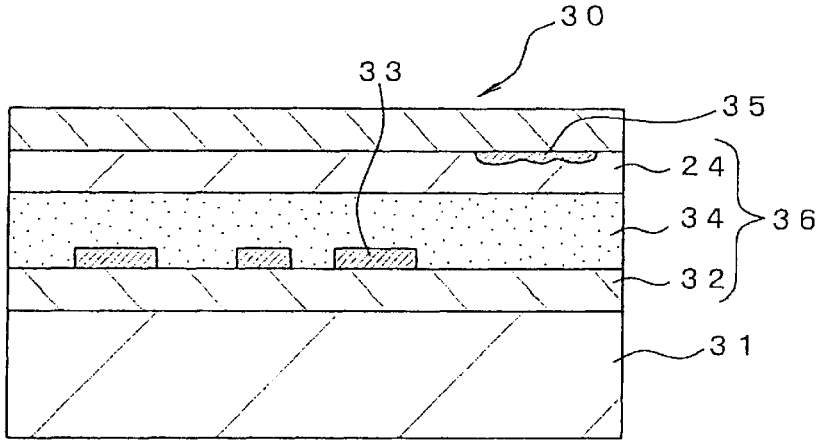
Figure 17C:
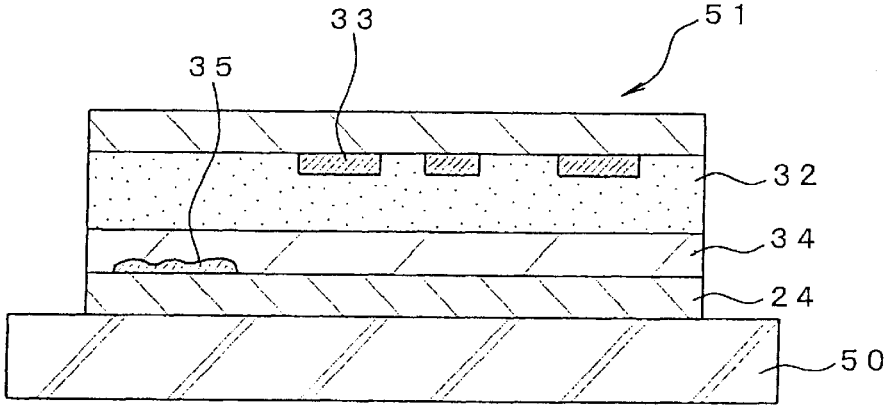
Figure 18A:
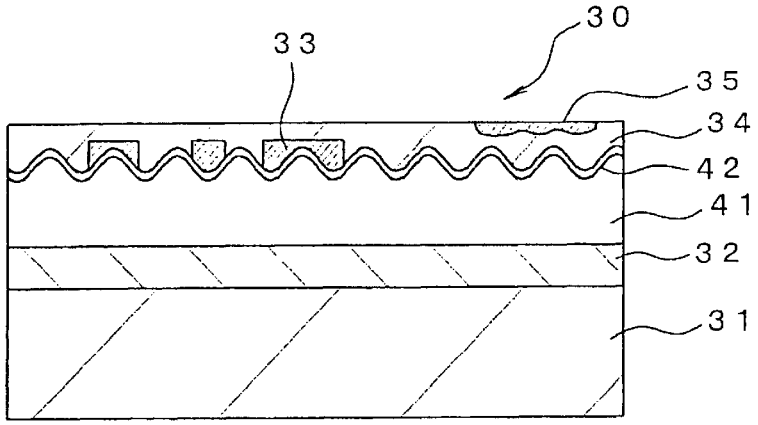
FIGS. 18(*a*)–(*c*) are schematic sectional views illustrating other example of the method for forming a security pattern formed matter of the present invention.
Figure 18B:
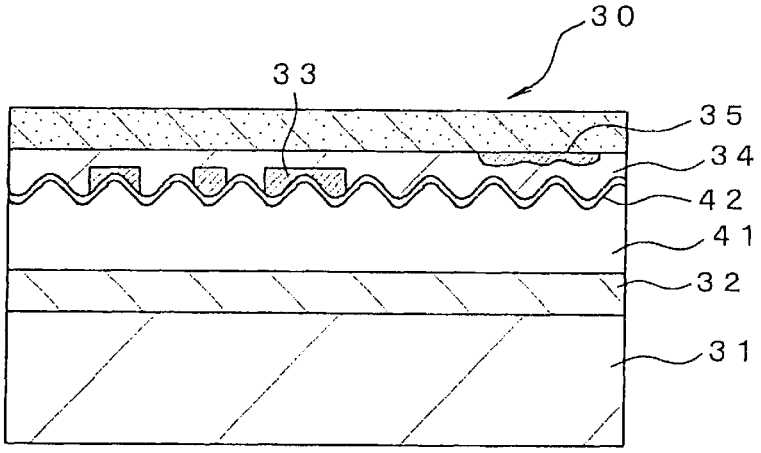
Figure 18C:
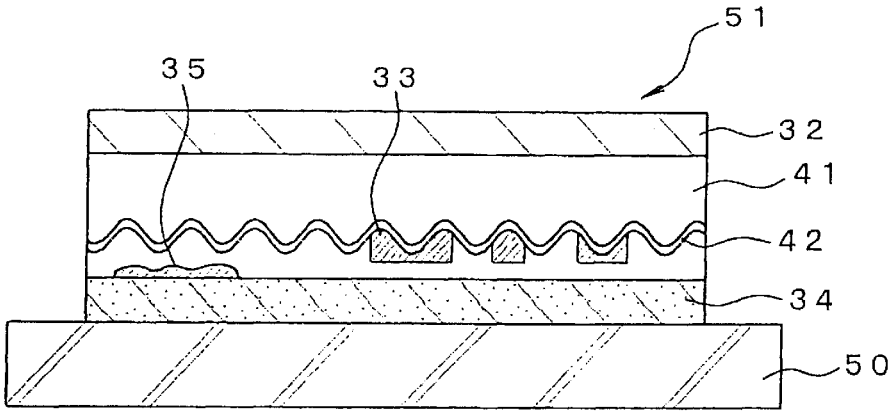
Figure 19A:
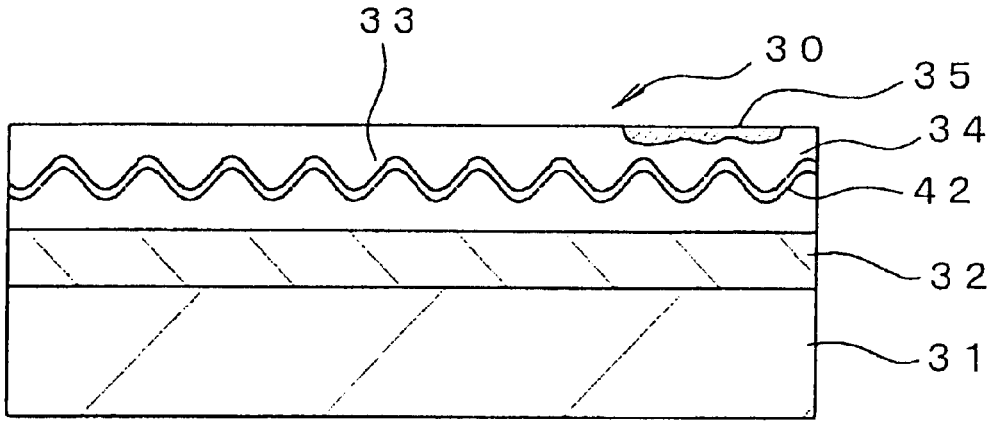
FIGS. 19(*a*)–(*d*) are schematic sectional views illustrating other example of the method for forming a security pattern formed matter of the present invention.
Figure 19B:
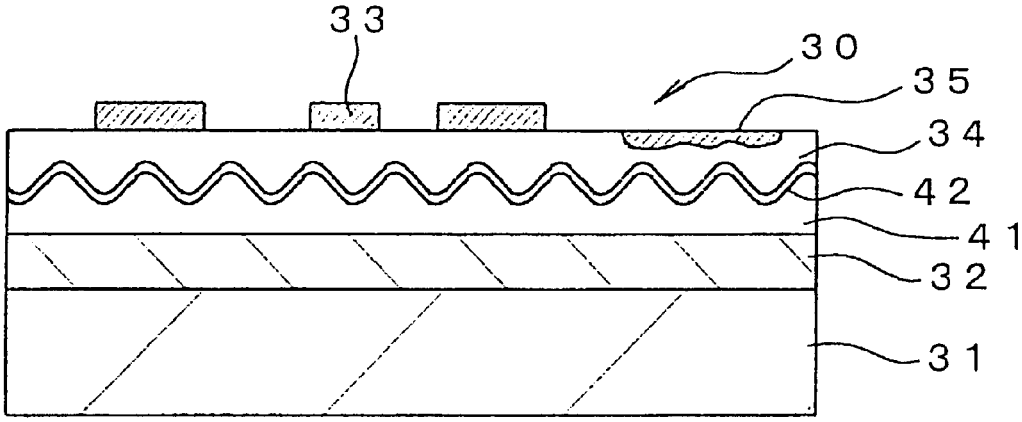
Figure 19C:
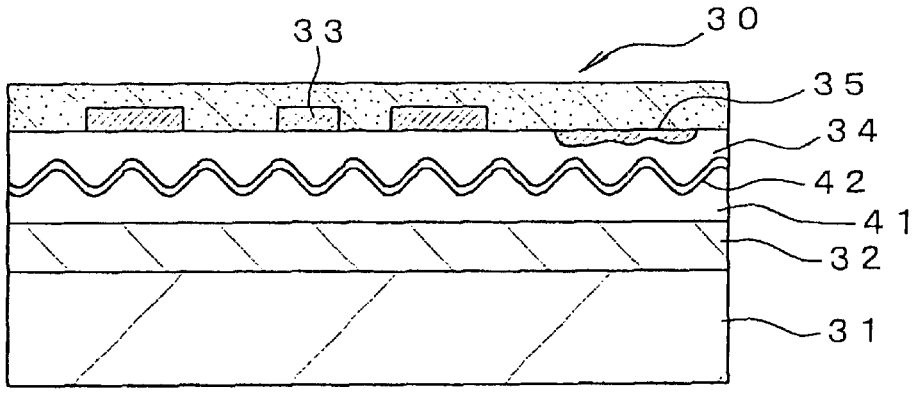
Figure 19D:
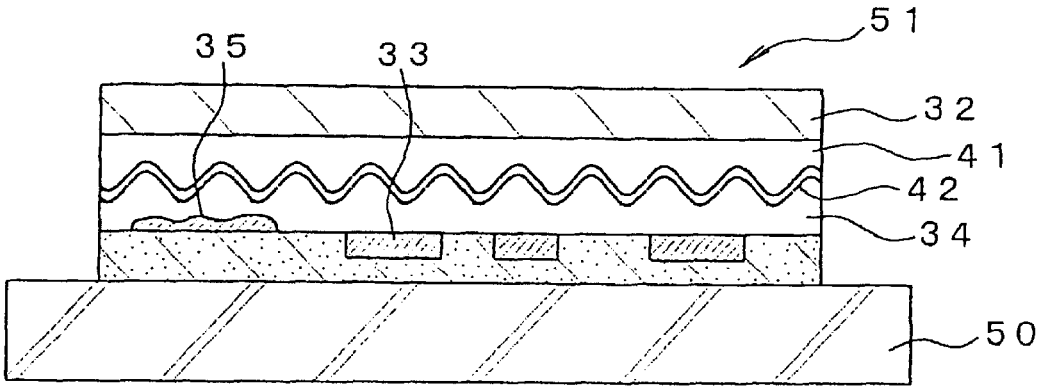
Figure 20A:
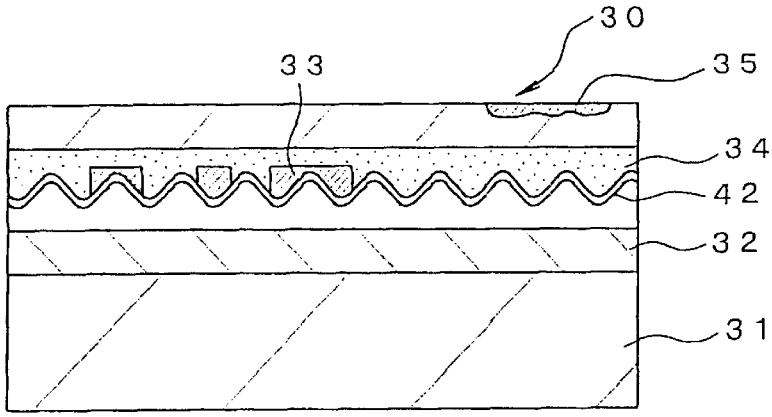
FIGS. 20(*a*)–(*c*) are schematic sectional views illustrating other example of the method for forming a security pattern formed matter of the present invention.
Figure 20B:
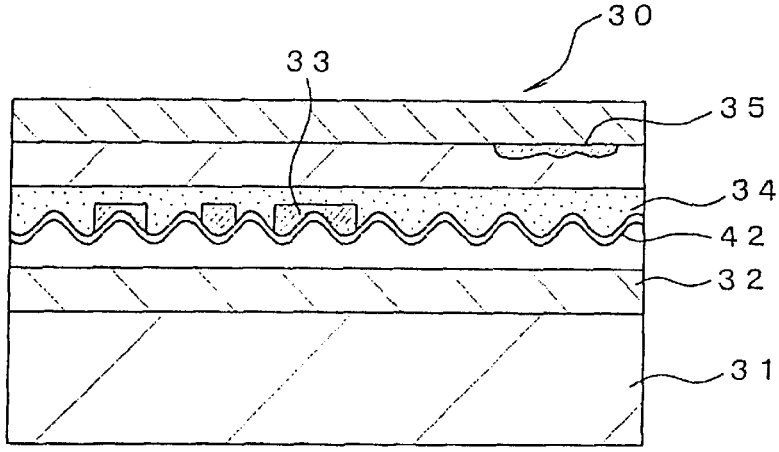
Figure 20C:
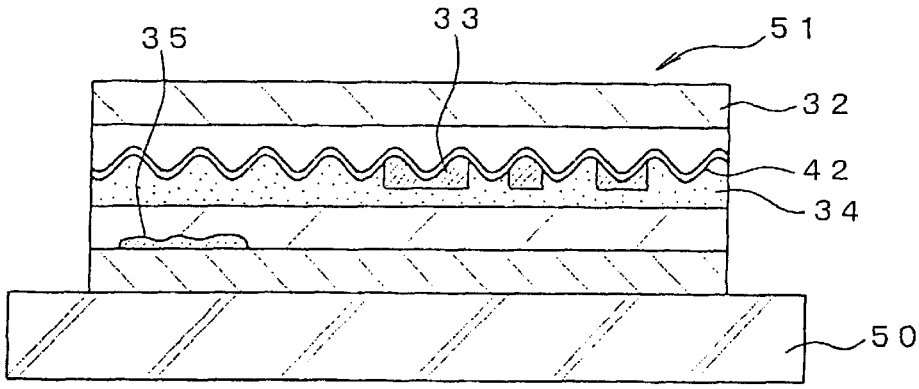

A security pattern can be formed through the steps illustrated in FIGS. 15(*a*)–15(*c*) by using, as shown in, e.g., FIG. 8, an intermediate transfer film 30 in which a releasing layer 32, an ultraviolet ray absorption pattern 33, and a receptor layer 34 where data can be recorded with a dye ink are successively formed on a substrate film 31, and using, as shown in FIG. 12, a dye transfer film in which a yellow ink layer 22Y, a magenta ink layer 22M, a cyan ink layer 22C, a thermal sublimation black ink layer 22BK (these ink layers are referred to as a dye ink layer 22), and a releasing layer 23 are formed on and successively along a surface of a substrate film and further a fluorescent adhesive layer 24 made of an adhesive ink containing a fluorescent material is formed on the releasing layer 23.

As shown in FIG. 15(*a*), the dye ink layer 22 of the dye transfer film is sublimated and transferred into a predetermined pattern to the receptor layer 34 of the intermediate transfer film 30, to form a visible image. In this way, data are recorded. Next, as shown in 15(*b*), the fluorescent adhesive layer 24 of the dye transfer film is melted and transferred onto the receptor layer and they are wholly stacked, to form the intermediate transfer medium 30 in which the releasing layer 32, the ultraviolet ray absorption pattern 33, the receptor layer 34 and a visible image 41 are formed as a transfer layer 36 on the substrate film. At last, as shown in FIG. 15(*c*), the transfer layer of the intermediate transfer medium 33 is transferred onto the surface of a transfer receiving material 50, to obtain a security pattern formed matter 51 having the fluorescent adhesive layer 24 and a fluorescent latent image made of the ultraviolet ray absorption pattern 33 and the visible image 41 positioned above the fluorescent adhesive layer 24.

When ultraviolet rays are radiated onto the security pattern formed matter, shown in FIG. 15(*c*), from a point above its surface, the ultraviolet ray absorption pattern 33 positioned above the fluorescent adhesive layer 24 absorbs the ultraviolet rays. As a result, the fluorescent image obtained by the radiation of the ultraviolet rays is a negative image of the ultraviolet ray absorption pattern 33.

The fluorescent latent image is used as a security pattern. A matter in which a fluorescent latent image is formed on a transfer receiving material is referred to as a security pattern formed matter. As the transfer receiving material, there are preferably used matters for which security is demanded, for example, various cards such as a passport, an ID card and a credit card, and licenses.

The ultraviolet absorption pattern 33 for forming the fluorescent latent image may be formed in any layer because of the following reason: if the pattern 33 is below fluorescent material layers such as the fluorescent adhesive layer 24 in the transfer layer 36 of the intermediate transfer medium 30, the pattern 33 is positioned above the fluorescent material layers after the transfer thereof to the transfer receiving material. The ultraviolet absorption pattern can be made from, e.g., a resin binder which an organic ultraviolet ray absorber is added to or is reacted with.

Examples of the organic ultraviolet ray absorber include salicylate, benzophenone, benzotriazole, substituted acrylonitryl, nickel-chelate, and hindered amine ultraviolet ray absorbers.

The reactive ultraviolet ray absorber which can be used may be obtained by introducing an addition polymerizable double bond of a vinyl, acryloyl, methacryloyl or the like group, or an alcoholic hydroxyl group, an amino group, a carboxyl group, an epoxy group, an isocyanate group or the like group to the above-mentioned organic ultraviolet ray absorber, and reacting/immobilizing the resultant with/on the a resin binder. The method for the reaction/immobilization is, for example, a method of radical-polymerizing a known resin component of a monomer, oligomer or reactive polymer with such a reactive ultraviolet ray absorber having an addition polymerizable double bond as above, to prepare a copolymer. In the case that the reactive ultraviolet ray absorber has a hydroxyl, amino, carboxyl, epoxy, or isocyanate group, a thermoplastic resin having reactivity with the above-mentioned reactive group and an optional catalyst are used to react/immobilize the reactive ultraviolet ray absorber with/on the thermoplastic resin.

Figure 14:
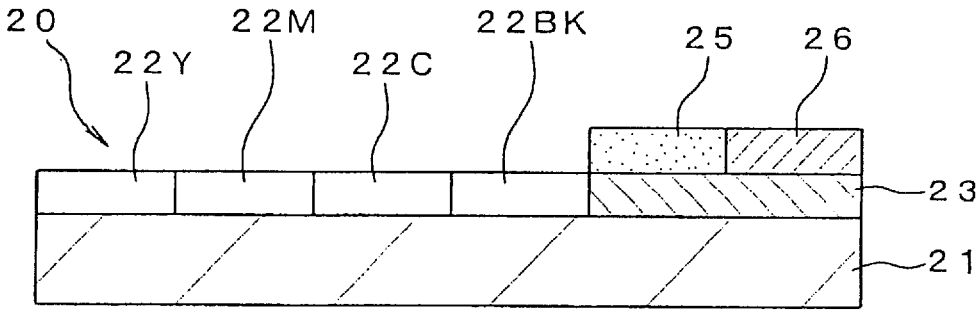
FIG. 14 is a schematic sectional view of other example of the dye transfer film used in the present invention.

The ultraviolet ray pattern 33 may be formed by any method, for example, a printing method using an ink containing the above-mentioned ultraviolet ray absorber, or a transfer method. As shown in FIG. 14, however, it is preferred to use the dye transfer film 20 wherein the ultraviolet ray absorber layer 25 is deposited on the surface of the releasing layer 23, and transfer the layer 25 to the intermediate transfer medium at the time of forming a visible image so as to form the pattern 33.

The releasing layer 32 of the intermediate transfer medium 30 is a layer which is stripped from the substrate film 31 at the time of the transfer to the transfer receiving material and is positioned as the topmost surface after the transfer to become a protective layer. The releasing layer may be made of a raw material used in a releasing layer of a known transfer sheet.

The releasing layer may be made from a composition comprising a binder resin and a releasing material. Examples of the binder resin include thermoplastic resins, for example, acrylic resins such as methyl polymethacrylate, ethyl polymethacrylate and butyl polyacrylate, vinyl resins such as polyvinyl acetate, vinyl chloride/vinyl acetate copolymer, polyvinyl alcohol and polyvinyl butyral, cellulose derivatives such as ethylcellulose, nitrocellulose and cellulose acetate; and thermosetting plastic resins, for example, unsaturated polyester, polyester, polyurethane, and aminoalkyd resins. Examples of the releasing material include waxes, silicone wax, silicone resin, melamine resin, fluorine resin, fine particles of talc or silica, a surfactant and lubricants such as a metal soap.

The releasing layer may be formed by dissolving or dispersing the above-mentioned resin into a suitable solvent to prepare a coating solution; applying the coating solution to the substrate film by a manner such as gravure printing, screen printing, or reverse coating using a photogravure; and drying the resultant. The thickness of the releasing layer is usually from 0.1 to 5 $\mu$m after the drying.

Figure 9:
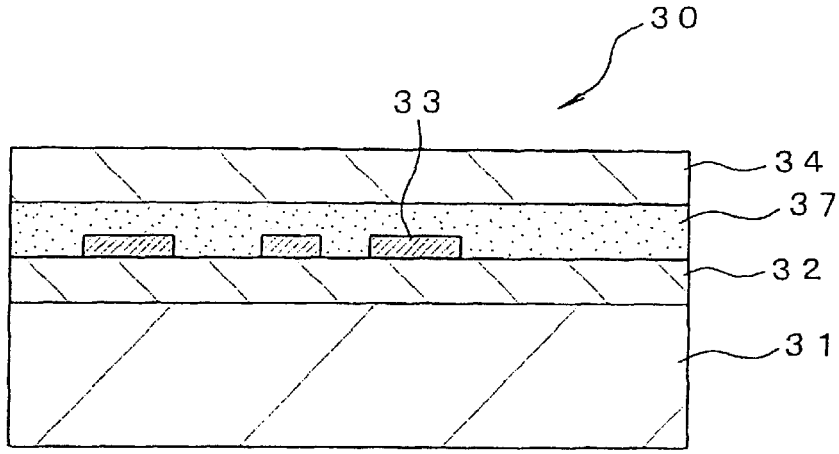
FIG. 9 is a schematic sectional view of another example of the intermediate transfer film used in the present invention.

In the intermediate transfer medium shown in FIG. 15(*b*), the fluorescent adhesive layer functions as an adhesive layer and a fluorescent material layer, but the fluorescent material layer and the adhesive layer may be formed as separate layers. As in an intermediate transfer film 30 shown in, e.g., FIG. 9, a releasing layer 32, an ultraviolet ray absorption pattern 33, a fluorescent material layer 37, and an adhesive layer 38 which also functions as a receptor layer may be successively formed on a surface of a substrate film 31. Data such as visible images are recorded on the adhesive layer 38 of the intermediate transfer film to prepare an intermediate transfer medium, and then the data are transferred to a surface of a transfer receiving material so that a security pattern formed matter can be obtained.

The adhesive layer which also functions as the receptor layer is made of a resin which can be dyed with dye in the same manner as the receptor layer of the thermal transfer image-receiving sheet. Examples of this resin include saturated polyester, polyamide, polyacrylate, polycarbonate, polyurethane, polyvinyl acetal, polyvinyl chloride, vinyl chloride/vinyl acetate copolymer, polyvinyl acetate, polystyrene, styrene/acrylate copolymer, styrene/butadiene copolymer, vinyltoluene/acrylate copolymer, and cellulose resin. The resins may be used alone or in the form of a mixture of two or more kinds. Additives, such as a releasing agent for preventing the melting bond of the thermal transfer sheet and various colorants may be added to the adhesive layer.

For the fluorescent material layer, it is preferred to use a material containing the fluorescent agent represented by the formula (1) used in the fluorescent latent image transfer film shown in, e.g., FIG. 1 or the fluorescent ink layer of this film, but materials containing the following fluorescent substances, besides the above, may be used.

The fluorescent substance is a substance which emits luminescence, and includes inorganic and organic fluorescent substances. As the inorganic fluorescent substances, there may be used a pigment obtained by sintering a crystal of an oxide, sulfide, silicate, phosphate, tungstate or the like of Ca, Ba, Mg, Zn, Cd or the like, as a main component, and a metal element such as Mn, Zn, Ag, Cu, Sb, Pb or a rare-earth element such as a lanthanoid element, as an active agent.

Preferred examples of the fluorescent substance include ZnO:Zn, Br (PO) Cl:Eu, ZnGeO:Mn, YO:Eu, Y (P,V) O:Bu, YOSi:Eu, and ZnGeO:Mn. As the organic fluorescent substance, there may be used diaminostilbene disulfonic acid derivatives, imidazole derivatives, coumarin derivatives, triazole derivatives, carbazole derivatives, pyridine derivatives, naphthalic acid derivatives, imidazolone derivatives, colorants such as fluoresein and eosine, and compounds having a benzene ring, such as anthracene.

The inorganic pigments are excellent in endurance and weather-resistance. The organic pigments are good in the wettability to an ink vehicle, and thus can easily be made up to ink even if they are not subjected to surface treatment. In order to improve endurance and weather-resistance, in particular, light-resistance and printability, preferred are inorganic fluorescent substances of stable oxides or salts of oxyacids which have a relatively large particle size and a high brightness, among the above-mentioned pigments. In particular, ZnO:Zn is satisfactory from the viewpoint of brightness and weather-resistance. Examples of the fluorescent substance also include rare-earth fluorescent substances.

To improve fluorescent properties, such as brightness, and printability of ink containing the fluorescent substance, the particle size of the fluorescent substance, i.e., the pigment is preferably adjusted. From such a viewpoint, the used fluorescent substance has an average particle size of preferably 0.7 to 4 $\mu$m, more preferably 0.7 to 2 $\mu$m, and most preferably 1 to 2 $\mu$m. It can be imagined that in general properties of the ink are more improved as the particle size of the pigment is smaller. However, if the particle size is less than 0.7 $\mu$m, the brightness of fluorescence drops remarkably. Therefore, it is preferred to use the fluorescent substance having a particle size of 0.7 $\mu$m or more. On the other hand, if the particle size is over 4 $\mu$m, the transparency of the resultant fluorescence emitting image drops.

The percentage of the fluorescent substance in the whole of the composition, except the solvent, constituting the fluorescent ink is preferably from 15 to 80% by weight and more preferably from 20 to 50% by weight, to improve brightness and transferability (adhesion) of the fluorescent substance to a print substrate. If the percentage of the fluorescent substance is less than 15%, the fluorescent brightness of the ink composition containing the fluorescent substance drops remarkably in some kind of the fluorescent substance. If the percentage is about 12%, the fluorescent brightness may be reduced to about 1/10 of the brightness of the pigment itself. The thickness of the fluorescence emitting image may be appropriately decided dependently on desired fluorescent brightness, the percentage of the fluorescent substance, and the like. For example the thickness may be set up to about 1–10 $\mu$m. From the viewpoint of ensuring transparency, in the present invention the fluorescent substance having a relatively small particle size is used as described above. However, the shortage of fluorescent intensity, based on the small particle size, can be compensated by increasing the thickness of the fluorescence emitting image.

In order to improve properties (hiding ability, coloring ability, oil-absorbance, endurance and the like) of the fluorescent substance, the fluorescent substance is preferably surface-treated. In particular, in the case of using inorganic pigment, the pigment is surface-treated to improve affinity to oiliness polymer since the surface of the pigment is hydrophilic and has poor affinity to the polymer. The method for the surface-treatment may be a method using, for example, a coating agent, a coupling agent, or a polymerizable monomer.

Figure 10:
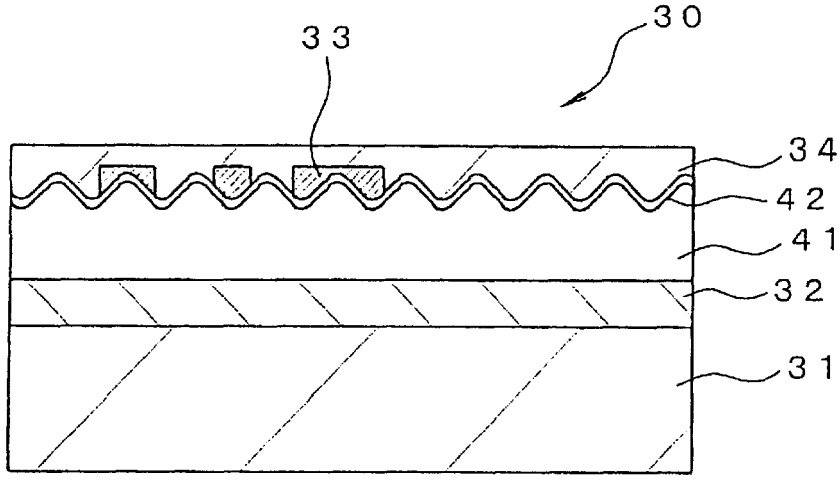
FIG. 10 is a schematic sectional view of still another example of the intermediate transfer film used in the present invention.
Figure 11:
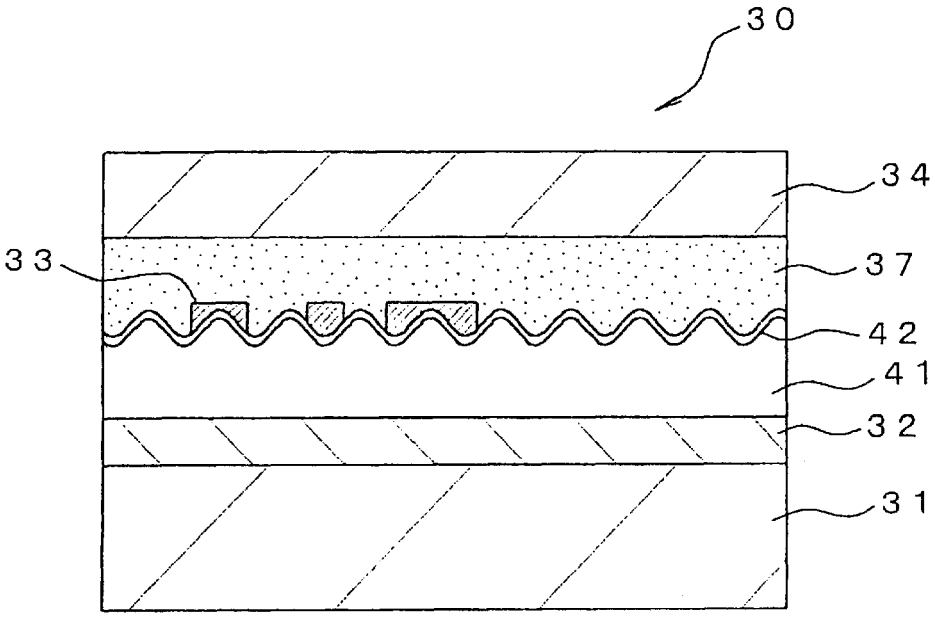
FIG. 11 is a schematic sectional view of other example of the intermediate transfer film used in the present invention.

As shown in FIGS. 10 and 11, a hologram may be made in the security pattern formed matter by the following method. A hologram effecting layer 41 is formed on a transfer layer and the surface of the layer 41 is subjected to fine embossment processing, so as to form a holographic pattern, and then titanium oxide or the like is evaporated onto the pattern to form the hologram formed of a thin metal layer 42. If a fluorescent latent image is used with other security means such as a hologram in this way, the security pattern formed matter can be made so as to have higher safety.

Examples of a substrate resin of the hologram effecting layer include unsaturated polyester resins, acrylic urethane resins, epoxy-modified acrylic resins, epoxy-modified unsaturated polyester resins, alkyd resins, phenol resins, and thermoplastic resins such as acrylic ester resins, acrylamide resins, nitrocellulose resins, and polystyrene resins. One or more of these resins may be blended with one or more of isocyanate resins, metal soaps such as cobalt naphthenoate and zinc naphthenoate, peroxides such as benezoylperoxide and methyl ethyl ketone peroxide, and thermal or ultraviolet ray hardening agents such as benzophenone, acetophenone, anthraquinone, naphtoquinone, azobisisobutyronitryl and diphenylsulfide. An ionizing radiating ray hardening resin may be used. This resin may be obtained by blending an oligomer of epoxyacrylate, urethaneacrylate, acryl-modified polyester or the like with, e.g., a monomer of neopentylglycol acrylate, trimethylolpropane triacrylate or the like for various purposes such as crosslinking or adjustment of viscosity.

Figure 13:
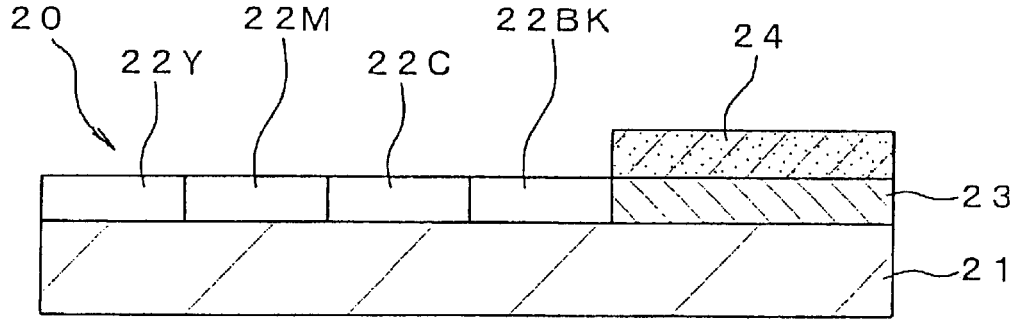
FIG. 13 is a schematic sectional view of another example of the dye transfer film used in the present invention.

To form the intermediate transfer medium, dye transfer films shown in FIGS. 12–14 may be used. These dye transfer films are formed as ink ribbons wherein various color ink layers 22 and a releasing layer 21 are formed on and successively along a transfer face and further layers such as an adhesive layer, an ultraviolet ray absorber layer or a fluorescent material layer are deposited on the releasing layer 21.

The other embodiments of the security pattern formed matter are illustrated in FIGS. 16–20.

EXAMPLES

Example 1

As a substrate film, polyethylene terephthalate film, having a thickness of 6 $\mu$m, (trade name: Lumilar, made by Toray Industries, Inc.) was prepared. A heat-resistant slip layer (back layer) of a silicone resin was formed on one surface of the substrate film by gravure coating, so as to have a thickness of 1 $\mu$m. A coating solution for a fluorescent ink layer, having the following composition, was applied, using a gravure coating method, onto the other surface and dried in the manner that the applied amount thereof was 0.6 g/m$^2$ after the drying. In this way, a fluorescent latent image transfer film was formed. The numbers of the fluorescent compounds in respective Examples are shown in Table 1.

Coating Solution 1 for the Fluorescent Ink Layer

| | |
|---|---|
| polyvinyl acetal resins (Sekisui Chemical Co., Ltd.) | 5 parts by weight |
| fluorescent compound No. 1 | 3 parts by weight |
| methyl ethyl ketone | 60 parts by weight |
| toluene | 22 parts by weight |
| isopropanol | 10 parts by weight |

Example 2

A fluorescent latent image transfer film was obtained in the same manner as in Example 1 except that a coating solution 2 for the fluorescent ink layer having the following composition was applied instead of the coating solution 1 for the fluorescent ink layer.

Coating Solution 2 for the Fluorescent Ink Layer

| | |
|---|---|
| polyvinyl acetal resins (Sekisui Chemical Co., Ltd.) | 5 parts by weight |
| fluorescent compound No. 2 | 3 parts by weight |
| methyl ethyl ketone | 60 parts by weight |
| toluene | 22 parts by weight |
| isopropanol | 10 parts by weight |

Example 3

A fluorescent latent image transfer film was obtained in the same manner as in Example 1 except that a coating solution 3 for the fluorescent ink layer having the following composition was applied instead of the coating solution 1 for a fluorescent ink layer.

Coating Solution 3 for the Fluorescent Ink Layer

| | |
|---|---|
| polyvinyl acetal resins (Sekisui Chemical Co., Ltd.) | 5 parts by weight |
| fluorescent compound No. 3 | 3 parts by weight |
| methyl ethyl ketone | 60 parts by weight |
| toluene | 22 parts by weight |
| isopropanol | 10 parts by weight |

Example 4

A fluorescent latent image transfer film was obtained in the same manner as in Example 1 except that a coating solution 4 for the fluorescent ink layer having the following composition was applied instead of the coating solution 1 for the fluorescent ink layer.

Coating Solution 4 for the Fluorescent Ink Layer

| | |
|---|---|
| polyvinyl acetal resins (Sekisui Chemical Co., Ltd.) | 5 parts by weight |
| fluorescent compound No. 4 | 3 parts by weight |
| methyl ethyl ketone | 60 parts by weight |
| toluene | 22 parts by weight |
| isopropanol | 10 parts by weight |

Example 5

A fluorescent latent image transfer film was obtained in the same manner as in Example 1 except that a coating solution 5 for the fluorescent ink layer having the following composition was applied instead of the coating solution 1 for the fluorescent ink layer.

Coating Solution 5 for the Fluorescent Ink Layer

| | |
|---|---|
| polyvinyl acetal resins (Sekisui Chemical Co., Ltd.) | 5 parts by weight |
| fluorescent compound No. 5 | 3 parts by weight |
| methyl ethyl ketone | 60 parts by weight |
| toluene | 22 parts by weight |
| isopropanol | 10 parts by weight |

Example 6

A fluorescent latent image transfer film was obtained in the same manner as in Example 1 except that a coating solution 6 for the fluorescent ink layer having the following composition was applied instead of the coating solution 1 for the fluorescent ink layer.

Coating Solution 6 for the Fluorescent Ink Layer

| | |
|---|---|
| polyvinyl acetal resins (Sekisui Chemical Co., Ltd.) | 5 parts by weight |
| fluorescent compound No. 6 | 3 parts by weight |
| methyl ethyl ketone | 60 parts by weight |
| toluene | 22 parts by weight |
| isopropanol | 10 parts by weight |

Example 7

A fluorescent latent image transfer film was obtained in the same manner as in Example 1 except that a coating solution 7 for the fluorescent ink layer having the following composition was applied instead of the coating solution 1 for the fluorescent ink layer.

Coating Solution 7 for the Fluorescent Ink Layer

| | |
|---|---|
| polyvinyl acetal resins (Sekisui Chemical Co., Ltd.) | 5 parts by weight |
| fluorescent compound No. 7 | 3 parts by weight |
| methyl ethyl ketone | 60 parts by weight |
| toluene | 22 parts by weight |
| isopropanol | 10 parts by weight |

Example 8

A fluorescent latent image transfer film was obtained in the same manner as in Example 1 except that a coating solution 8 for the fluorescent ink layer having the following composition was applied instead of the coating solution 1 for the fluorescent ink layer.

Coating Solution 8 for the Fluorescent Ink Layer

| | |
|---|---|
| polyvinyl acetal resins (Sekisui Chemical Co., Ltd.) | 5 parts by weight |
| fluorescent compound No. 8 | 3 parts by weight |
| methyl ethyl ketone | 60 parts by weight |
| toluene | 22 parts by weight |
| isopropanol | 10 parts by weight |

Example 9

A fluorescent latent image transfer film was obtained in the same manner as in Example 1 except that a coating solution 9 for the fluorescent ink layer having the following composition was applied instead of the coating solution 1 for the fluorescent ink layer.

Coating Solution 9 for the Fluorescent Ink Layer

| | |
|---|---|
| polyvinyl butyral resins (Sekisui Chemical Co., Ltd.) | 5 parts by weight |
| fluorescent compound No. 8 | 3 parts by weight |
| methyl ethyl ketone | 60 parts by weight |
| toluene | 22 parts by weight |
| isopropanol | 10 parts by weight |

Comparative Example 1

A transfer film was obtained in the same manner as in Example 1 except that the fluorescent compound No. 1 was removed from the coating solution 1 for the fluorescent ink layer.

Transfer properties of Examples 1–9 and Comparative Example 1 were compared and evaluated. The results are shown in Table 2.

TABLE 2

| | Transferability | Gradiation-property |
|---|---|---|
| Example 1 | ○ | ○ |
| Example 2 | ○ | ○ |
| Example 3 | ○ | ○ |
| Example 4 | ○ | ○ |
| Example 5 | ○ | ○ |
| Example 6 | ○ | ○ |
| Example 7 | ○ | ○ |
| Example 8 | ○ | ○ |
| Example 9 | ○ | ○ |
| Comparative Example 1 | X | X |

Evaluation Method

A commercially available sublimation transfer image-receiving sheet and a card were put on the transfer film of each of Examples 1–9 and Comparative Examples, and then a thermal printer was used to print a gradation pattern having printing energy of 16 gradations.

Fluorescent agent transferability: The printed gradation pattern was irradiated with ultraviolet rays having wavelengths of 300 to 400 nm, and then it was observed how the gradation pattern was recognized. On the basis of the following criteria, the transfer films were ranked as ○ or X.

○: Fluorescent luminescence was vividly recognized.

X: The printed pattern was not recognized.

Gradiation-property: The transfer films were ranked as ○ or X.

○: The intensity of fluorescent luminescence increased smoothly as the printing energy of the gradation pattern became higher.

X: Other results than the above were obtained.

Preparation Example 1 of the Fluorescent Latent Image Transfer Film

The same fluorescent latent image transfer film as in Example 8 was prepared.

Preparation Example 2 of the Fluorescent Latent Image Transfer Film

To the fluorescent latent image layer prepared in the above-mentioned Preparation Example 1 of the fluorescent latent image transfer film, yellow, magenta, cyan and black sublimation dye layers, a fluorescent ink layer, a black thermal transfer resin layer and a protective layer were repeatedly formed on and successively along the substrate film by gravure printing in the manner that the panel length of the respective colors (or the respective layers) was 15 cm. The resultant was then dried. In this way, a fluorescent latent image transfer film was formed wherein 4-color dye layers, the black resin layer, the fluorescent ink layer and the protective layer were integrated.

Preparation Example 3 of the Fluorescent Latent Image Transfer Film

An integration-type fluorescent latent image transfer film was obtained in the same manner as in Preparation Example 2 of the fluorescent latent image transfer film except that each of the fluorescent ink layers was positioned after each of the protective layers.

Preparation Example 4 of the Fluorescent Latent Image Transfer Film

An integration-type fluorescent latent image transfer film, wherein a fluorescent ink layer and a hologram protective layer were integrated, was obtained in the same manner as in Preparation Example 2 of the fluorescent latent image transfer film except that a holographic pattern was formed in the protective layer.

Example 10

The following sublimation thermal transfer sheet was put on the thermal transfer image-receiving sheet and then thermal energy was supplied thereto by using a thermal head of a printer which can be operated by electrical signals resulting from color-decomposition of a facial photograph, so as to form a full color image.

Next, the image-receiving sheet on which the above-mentioned full color image was formed was put on the transfer film of Preparation Example 1 of the fluorescent latent image transfer film. In accordance with electrical signals resulting from a monochromic image rich in gradations, which was different from the facial photograph, the thermal head of the above-mentioned printer was used to form a fluorescent latent image. In this way, a printed matter having the fluorescent latent image was obtained.

Sublimation thermal transfer sheet: A primer layer made of an urethane resin and having a thickness of 0.5 $\mu$m was formed on one surface of a polyethylene terephtalate film of 6 $\mu$m in thickness (Lumilar: Toray Industries, Inc.). A heat-resistant slip layer of 1 $\mu$m in thickness was formed on the other surface (back face). The following yellow ink, magenta ink and cyan ink compositions were repeatedly formed on the surface of the primer layer and successively along the feeding direction of the polyester film by gravure printing in the manner that the length of the respective panels was 15 cm. The resultant was then dried to form 3 color sublimation ink layers. In this way, a sublimation thermal transfer sheet was formed. The applied amount of each of the 3-color inks was set up to 3 g/m$^2$ (solid amount). The 3-color inks containing a sublimation dye were prepared as follows.

Yellow Ink Composition

Quinophthalone having the following structural formula 3.5 parts by weight polybutyl butyral (Eslex BX-1 made by Sekisui Chemical Co., Ltd.) 4.5 parts by weight methyl ethyl ketone/toluene (1/1) 90.0 parts by weight

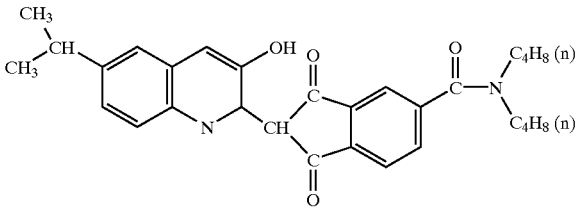

wherein n represents normal.

Magenta Ink Composition

A magenta ink composition was obtained in the same manner as in the preparation of the above-mentioned yellow ink composition except that the dye was replaced by C.I. Disperse Red 60.

Cyan Ink Composition

A cyan ink composition was obtained in the same manner as in the preparation of the yellow ink composition except that the dye was replaced by C.I. Solvent Blue 63.

A synthetic paper (Yupo FPG-150 made by Oji Yuka Synthetic Paper Co., Ltd., thickness: 150 $\mu$m) was used as a substrate film, and a coating solution for a dye receptor layer having the following composition was applied to one surface of the film with a bar coater in such a manner that the applied amount after drying would be 4 g/m$^2$. The applied layer was dried to form a dye receptor layer. In this way, a thermal transfer image-receiving sheet was prepared.

| [Coating solution for a dye receptor layer] | |
|---|---|
| vinyl chloride/vinyl acetate copolymer (Denka vinyl 1000A, made by Denki Kagaku Kogyo K.K.) | 20.0 parts by weight |
| epoxy-modified silicone oil (X-22-3000T, made by Shin-Etsu Chemical Co., Ltd.) | 1.0 part by weight |
| methyl ethyl ketone/toluene (1/1) | 80.0 parts by weight |

Example 11

In example 10, the same manner as in Example 10 was performed except that a fluorescent latent image was formed before the full color image was formed, so as to obtain a printed matter having the fluorescent latent image.

Example 12

The same manner as in Example 10 was performed except that a protective layer was formed on the printed matter of Example 10 having the full color image and the fluorescent latent image, so as to obtain a printed matter.

Example 13

In example 10, the same manner as in Example 10 was performed except that a protective layer was first formed on the printed matter having the full color image and subsequently a fluorescent latent image was formed on the protective layer, so as to obtain a printed matter.

Example 14

Using the film wherein the 4-color dye layers, the fluorescent latent image layer, the black resin layer, and the protective layer were integrated, which was prepared in Preparation 2 of the fluorescent latent image transfer film, the full color image described in Example 10 was formed on the thermal transfer image-receiving sheet with the yellow, magenta and cyan dyes. Next, the black dye layer was used to print a sign and information on a fingerprint on an area, which was different from the facial photograph full color image, of the thermal transfer image-receiving sheet. Thereafter, the fluorescent ink layer was used to form a fluorescent latent image in accordance with electrical signals obtained from the monochromic image of Example 10, and then the black ink resin layer was used to print character information on a name, a birthday, an address and the like, and a bar code. Finally, the protective layer was transferred to the thermal transfer image-receiving sheet to cover the whole of these images on the sheet.

Example 15

In example 14, the same manner as in Example 14 was performed except that the integration type film of Preparation 3 of the fluorescent latent image transfer film was used to form a fluorescent latent image after the formation of the protective layer instead of the way that the integration type film of Preparation 2 of the fluorescent latent image transfer was used to form the protective layer after the formation of the fluorescent latent image, so as to obtain a printed matter.

Example 16

The same manner as in Example 14 was performed except that the integration type film of Preparation 3 of the fluorescent latent image transfer was used instead of the integration type film of Preparation 2 of the fluorescent latent image transfer film, and a protective layer having a hologram pattern was transferred, so as to obtain a printed matter having the hologram pattern.

Example 17

The same manner as in Example 14 was performed except that a card was used as the thermal transfer image-receiving sheet, so as to obtain a printed matter in a card form.

Example 18

The same manner as in Example 14 was performed except that a passport booklet was used as the thermal transfer image-receiving sheet, so as to obtain a printed matter.

Example 19

The same manner as in Example 14 was performed except that a license was used as the thermal transfer image-receiving sheet, so as to obtain a printed matter.

Concerning Examples 10–19, the visibility of the fluorescent latent images thereof was evaluated. The results are shown in Table 3. In the evaluation method, the printed matters were irradiated with ultraviolet rays having wavelengths of 300 to 400 nm, and it was observed with eyes whether or not the fluorescent images were clearly recognized. The printed matters whose fluorescent luminescence was vividly recognized were ranked as ○, and the printed matters whose fluorescent luminescence (i.e., printed pattern of the fluorescent latent image) was not recognized were ranked as X. As shown in Table 3, in all of Examples 10–19, fluorescent luminescence was vividly recognized.

TABLE 3

| Sample No. | Visibility of fluorescent latent images |
|---|---|
| Example 10 | ○ |
| Example 11 | ○ |
| Example 12 | ○ |
| Example 13 | ○ |
| Example 14 | ○ |
| Example 15 | ○ |
| Example 16 | ○ |
| Example 17 | ○ |
| Example 18 | ○ |
| Example 19 | ○ |

Intermediate Transfer Medium (1)

A releasing layer (thickness: 1.5 μm), which also functioned as a protective layer, and an ultraviolet ray absorption pattern (1.0 μm) were gravure-printed on a surface of a transparent substrate (12 μm) of polyethylene terephthalate, and then a dye receptor layer (2.0 μm) was formed thereon by gravure coating.

Intermediate Transfer Medium (2)

A releasing layer (thickness: 1.5 μm), which also functioned as a protective layer, and an ultraviolet ray absorption pattern (1.0 μm) were gravure-printed on a surface of a transparent substrate (12 μm) of polyethylene terephthalate, and then a fluorescent material layer (3.0 μm) and a dye receptor layer (2.0 μm) were successively formed thereon by gravure coating.

Intermediate Transfer Medium (3)

A releasing layer (thickness: 1.5 μm), which also functioned as a protective layer, and a hologram effecting layer (2.0 μm) were formed on a surface of a transparent substrate (12 μm) of polyethylene terephthalate by gravure coating. The surface of the hologram effecting layer was subjected to a fine embossment processing to form a hologram pattern. Next, titanium oxide (500 Å) was evaporated on the surface of the hologram effecting layer after the embossment processing. Further, an ultraviolet ray absorption pattern (1.0 μm) was printed thereon, and then a receptor layer (2.0 μm) was formed thereon by gravure coating.

Intermediate Transfer Medium (4)

A releasing layer (thickness: 1.5 μm), which also functioned as a protective layer, and a hologram effecting layer (2.0 μm) were formed on a surface of a transparent substrate (12 μm) of polyethylene terephthalate by gravure coating. The surface of the hologram effecting layer was subjected to a fine embossment processing to form a hologram pattern. Next, titanium oxide (500 Å) was evaporated on the surface of the hologram effecting layer after the embossment processing. Further, an ultraviolet ray absorption pattern (1.0 μm) was printed thereon, and then a fluorescent material layer (3.0 μm) and a receptor layer (2.0 μm) were formed thereon by gravure coating.

Coating Solution for the Stripping (and Protective) Layer (All of the Words "Part(s)" Means Part(s) by Weight Hereinafter.)

| | |
|---|---|
| acrylic resin | 40 parts |
| polyester resin | 2 parts |
| methyl ethyl ketone | 50 parts |
| toluene | 50 parts |

Coating Solution for the Hologram Effecting Layer

| | |
|---|---|
| acrylic resin | 40 parts |
| melamine resin | 10 parts |
| cyclohexanone | 50 parts |
| methyl ethyl ketone | 50 parts |

Coating Solution for the Receptor Layer

| | |
|---|---|
| vinyl chloride/vinyl acetate copolymer | 50 parts |
| acrylic silicone | 1.5 parts |
| methyl ethyl ketone | 50 parts |
| toluene | 50 parts |
| Ink for the fluorescent material | |
| Byron 270 (polyester resin) | 30 parts |
| Yubitex OB | 1 parts |
| Toluene | 35 parts |
| methyl ethyl ketone | 35 parts |

Ultraviolet Ray Absorption Layer Ink 1

Copolymer Resin Reacted with and Bonded to a Reactive Ultraviolet

| | |
|---|---|
| ray absorber (UVA-635L, made by BASF Japan Co., Ltd.) | 40 parts |
| zinc antimonate | 40 parts |
| methyl ethyl ketone | 30 parts |
| toluene | 30 parts |
| Adhesive layer ink | |
| chlorovinyl acetate resin | 30 parts |
| toluene | 35 parts |
| methyl ethyl ketone | 35 parts |

Dye Film (1)

Yellow, magenta and cyan inks were deposited on a PET film and successively along the feeding direction of the film by gravure coating (coating amount: 3.0 μm).

Subsequently, a releasing layer was formed on and successively along the film. An adhesive layer was deposited on the releasing layer.

Dye Film (2)

Yellow, magenta and cyan inks were deposited on a PET film and successively along the feeding direction of the film by gravure coating (coating amount: 3.0 μm).

Subsequently, a releasing layer was formed on and successively along the film. An adhesive layer ink and an ink for a fluorescent material were blended in equivalent amounts to form an adhesive and fluorescent material layer on the releasing layer.

Dye Film (3)

Yellow, magenta and cyan inks were deposited on a PET film and successively along the feeding direction of the film by gravure coating (coating amount: 3.0 μm).

Subsequently, a releasing layer was formed on and successively along the film. An ultraviolet ray absorber layer was then formed on the releasing layer. Further, an adhesive layer ink and an ink for a fluorescent material were blended in equivalent amounts to form an adhesive and fluorescent material layer on the releasing layer.

The respective color inks of the dye films has the following compositions.

| | |
|---|---|
| [Yellow ink] | |
| quinophthalone dye represented by the following structural formula | |
| (C. I. Disperse Yellow 58) | 5.5 parts |
| polyvinyl butyral | 4.5 parts |
| (Eslex BX-1, made by Sekisui Chemical Co., Ltd. ) | |
| methyl ethyl ketone/toluefle (1/1) | 90.0 parts |

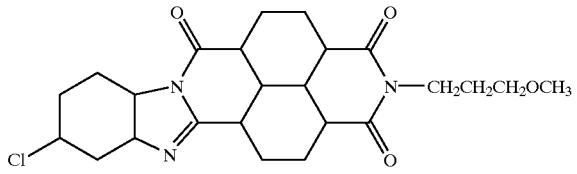

<Magenta Ink>

In the above-mentioned yellow ink, the dye was replaced by C. I. Disperse Red 60, so as to obtain a magenta ink.

<Cyan Ink>

In the above-mentioned yellow ink, the dye was replaced by C. I. Solvent Blue 63, so as to obtain a cyan ink.

Security Pattern Formed Matter (1)

The intermediate transfer medium (1) and the dye film (2) were used to form a sublimation dye image on the receptor layer of the intermediate transfer medium (1), and the fluorescent material and adhesive layer was transferred into a solid form. Subsequently, the adhesive layer was transferred. Thereafter, the image and these layers were again transferred to a passport booklet, to obtain a recorded medium.

Security Pattern Formed Matter (2)

The intermediate transfer medium (1) and the dye film (3) were used to form a sublimation dye image on the receptor layer of the intermediate transfer medium (1), and the ultraviolet ray absorption layer was transferred into a pattern form with a thermal head. The fluorescent material and adhesive layer was transferred into a solid form. Thereafter, the image and these layers were again transferred to a passport booklet, to obtain a recorded medium.

Security Pattern Formed Matter (3)

The intermediate transfer medium (2) and the dye film (1) were used to form a sublimation dye image on the receptor layer of the intermediate transfer medium (2), and the adhesive layer was transferred. Thereafter, the image and the layer were again transferred to a passport, to obtain a recorded medium.

Security Pattern Formed Matter (4)

The intermediate transfer medium (3) and the dye film (2) were used to form a sublimation dye image on the receptor layer of the intermediate transfer medium (3). The fluorescent material and adhesive layer was transferred into a solid form, and the adhesive layer was transferred. Thereafter, the image and these layers were again transferred to a passport booklet, to obtain a recorded medium.

Security Pattern Formed Matter (5)

The intermediate transfer medium (3) and the dye film (3) were used to form a sublimation dye image on the receptor layer of the intermediate transfer medium (3), and the ultraviolet ray absorption layer was transferred into a pattern form with a thermal head. The fluorescent material and adhesive layer was transferred into a solid form. Thereafter, the image and the layers were again transferred to a passport booklet, to obtain a recorded medium.

Security Pattern Formed Matter (6)

The intermediate transfer medium (4) and the dye film (1) were used to form a sublimation dye image on the receptor layer of the intermediate transfer medium (4), and the adhesive layer was transferred. Thereafter, the image and the layer were again transferred to a passport, to obtain a recorded medium.

Comparative Example

Comparative Example 1

A releasing layer (thickness: 1.5 μm), which also functioned as a protective layer was gravure-printed on a surface of a transparent substrate (12 μm) of polyethylene terephthalate, and then a fluorescent luminescence pattern (1.0 μm) was gravure-printed. A dye receptor layer (2.0 μm) was formed thereon by gravure coating.

Comparative Example 2

A releasing layer (thickness: 1.5 μm), which also functioned as a protective layer, and a fluorescent luminescence pattern (3.0 μm) were gravure-printed on a surface of transparent substrate (12 μm) of polyethylene terephthalate, and a dye receptor layer (2.0 μm) were formed thereon by gravure coating.

Comparative Example 3

A releasing layer (thickness: 1.5 μm), which also functioned as a protective layer, and a fluorescent luminescence pattern (1.0 μm) were gravure-printed on a surface of a transparent substrate (12 μm) of polyethylene terephthalate, and then a dye receptor layer (2.0 μm) was formed thereon by gravure coating.

Ink for the Dye Material

| | |
|---|---|
| Byron 270 (polyester resin) | 30 parts |
| Yubitex OB | 10 parts |
| Toluene | 35 parts |
| methyl ethyl ketone | 35 parts |

TABLE 4

| | Visibility | Information Changeability | Hiding Ability | Reproductivity | Preservation Property |
|---|---|---|---|---|---|
| Examples | | | | | |
| Security Pattern Formed Matter (1) | ○ | X | ○ | ○ | ○ |
| (2) | ○ | ○ | ○ | ○ | ○ |
| (3) | ○ | X | ○ | ○ | ○ |
| (4) | ○ | X | ○ | ○ | ○ |
| (5) | ○ | ○ | ○ | ○ | ○ |
| (6) | ○ | X | ○ | ○ | ○ |
| Comparative Example (1) | X | X | ○ | ○ | ○ |
| Comparative Example (2) | ○ | X | X | X | X |
| Comparative Example (3) | ○ | X | X | X | ○ |

Visibility: visibility of fluorescent latent images with eyes (○: easy, X: difficult)
Information Changeability: changeability of fluorescent latent image patterns (○: possible, X: impossible)
Hiding ability: visibility of fluorescent latent images with eyes under a usual light source (white light or sunlight) (○: impossible, X: unfavorably, possible)
Reproductivity: print reproductivity of a minute pattern (○: good, X: bad)
Preservation: occurrence of blocking or the like when the security pattern formed matters were preserved in a roll form (○: good, X: bad)

In the present invention, any layer structure is allowable so far as the layer structure can have an ultraviolet ray absorption pattern and a fluorescent material layer simultaneously by combining the intermediate transfer medium (1)–(6) with the dye film (1)–(3).

What is claimed is:

1. A security pattern formed matter, which is a printed matter wherein a receptor layer on which information is recorded and a security pattern composed of a fluorescent latent image are at least formed on a surface of a transfer receiving material, the security pattern being composed of a fluorescent material layer and an ultraviolet ray absorption pattern formed into a pattern form on/above the fluorescent material layer, and an intermediate transfer medium wherein the receptor layer, the ultraviolet ray absorption pattern, and the fluorescent material layer are formed as transfer layers being used so that the transfer layers of the intermediate transfer medium are transferred onto the surface of the transfer receiving material.

2. The security pattern formed matter according to claim 1, wherein the ultraviolet ray absorption pattern is formed by using an ultraviolet ray absorber transfer film having an ultraviolet ray absorber layer and heating the transfer film in any pattern by means of a heating element to transfer the ultraviolet ray absorber layer correspondingly to the pattern of the heating element.

3. The security pattern formed matter according to claim 1, wherein the fluorescent material layer is a layer formed by using a fluorescent latent image transfer film having a fluorescent ink layer composed of a resin binder comprising a fluorescent agent.

4. A method for forming a security pattern, comprising the steps of using an intermediate transfer medium wherein a transfer layers comprising a fluorescent latent image composed of an ultraviolet ray absorption pattern and a fluorescent material layer, and a receptor layer on which information is recorded is formed on a substrate film, so as to transfer the transfer layers of the intermediate transfer medium on a transfer receiving medium, thereby forming a security pattern, the intermediate transfer medium being a medium wherein the fluorescent latent image is formed in the manner that the ultraviolet ray pattern in the transfer layer after the transfer is positioned on/above the fluorescent ink layer.

5. A dye transfer film, which is a thermal transfer medium wherein a dye layer and an adhesive layer are formed on and successively along a surface of a substrate film.

* * * * *

UNITED STATES PATENT AND TRADEMARK OFFICE

CERTIFICATE OF CORRECTION

PATENT NO. : 6,828,274 B2
APPLICATION NO. : 10/047838
DATED : January 14, 2002
INVENTOR(S) : Jiro Onishi et al.

It is certified that error appears in the above-identified patent and that said Letters Patent is hereby corrected as shown below:

| where | correction |
|---|---|
| Column 30, line 53 | After "substitute film" insert --, the adhesive layer comprising a fluorescent material -- |

Signed and Sealed this

Thirtieth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 6,828,274 B2
APPLICATION NO. : 10/047838
DATED : December 7, 2004
INVENTOR(S) : Jiro Onishi et al.

It is certified that error appears in the above-identified patent and that said Letters Patent is hereby corrected as shown below:

| where | correction |
|---|---|
| Column 30, line 53 | After "substitute film" insert --, the adhesive layer comprising a fluorescent material -- |

This certificate supersedes Certificate of Correction issued January 30, 2007.

Signed and Sealed this

Twentieth Day of March, 2007

JON W. DUDAS
*Director of the United States Patent and Trademark Office*